US006167211A

United States Patent [19]

Oogi et al.

[11] Patent Number: 6,167,211

[45] Date of Patent: Dec. 26, 2000

[54] IMAGE FORMING APPARATUS HAVING A FUNCTION FOR RECYCLING COLLECTED TONER AND CONTROL METHOD THEREOF

[75] Inventors: Syuji Oogi, Toyohashi; Toshihide Taniguchi, Toyokawa, both of Japan

[73] Assignee: Minolta Co., Ltd., Osaka, Japan

[21] Appl. No.: 09/379,469

[22] Filed: Aug. 24, 1999

[30] Foreign Application Priority Data

| | | | |
|---|---|---|---|
| Aug. 25, 1998 | [JP] | Japan | 10-239114 |
| Sep. 11, 1998 | [JP] | Japan | 10-258220 |
| Sep. 11, 1998 | [JP] | Japan | 10-258221 |
| Sep. 11, 1998 | [JP] | Japan | 10-258222 |
| Sep. 11, 1998 | [JP] | Japan | 10-258223 |

[51] Int. Cl.[7] ..... G03G 15/08; G03G 21/10

[52] U.S. Cl. ..... 399/53; 399/66; 399/359; 399/360

[58] Field of Search ..... 399/93, 92, 98, 399/99, 53, 66, 71, 358, 359, 360

[56] References Cited

U.S. PATENT DOCUMENTS

| | | | |
|---|---|---|---|
| 5,028,959 | 7/1991 | Gooray | 399/93 |
| 5,493,382 | 2/1996 | Takagaki et al. | 399/359 |
| 5,521,690 | 5/1996 | Taffler et al. | 399/93 |
| 5,604,575 | 2/1997 | Takagaki et al. | 399/359 |
| 5,604,576 | 2/1997 | Inoue et al. | 399/255 |

FOREIGN PATENT DOCUMENTS

| | | |
|---|---|---|
| 59-42566 | 3/1984 | Japan . |
| 59-148080 | 8/1984 | Japan . |
| 4-54955 | 9/1992 | Japan . |
| 5-59428 | 8/1993 | Japan . |
| 2668527 | 7/1997 | Japan . |
| 9-269708 | 10/1997 | Japan . |
| 9-281783 | 10/1997 | Japan . |
| 10-240093 | 9/1998 | Japan . |
| 10-326069 | 12/1998 | Japan . |

*Primary Examiner*—Joan Pendegrass
*Attorney, Agent, or Firm*—Burns, Doane, Swecker & Mathis, LLP

[57] ABSTRACT

In an image forming apparatus and a controlling method thereof, the image forming apparatus comprises conveyer mechanisms for conveying collected toner to a waste part or a recycling part, and a controller for controlling the conveyer mechanism and a developer supplying device according to image forming conditions. When the image forming condition exceeds a predetermined reference level, the controller decreases a recycling rate of the collected toner. If the recycling rate becomes high as a result of the controlling, the controller decreases an amount of supplying the developer so as to lower toner density. Thus, reference toner density in the developer is controlled, thereby, high quality images can be maintained, and the controller can be simplified.

60 Claims, 26 Drawing Sheets

*FIG. 19*

| | DIFFERENCE OF RESISTANCE DETECTED BY AIDC SENSOR (DUTY) | | | | |
|---|---|---|---|---|---|
| | 0 - 5 | 6 - 10 | 11 - 15 | 16 - 20 | 21 - 25 |
| RECYCLED TONER SUPPLYING RATE (%) | 100 | 75 | 50 | 25 | 0 |

*FIG. 20*

| | RECYCLING TONER SUPPLYING RATE (%) | | | | |
|---|---|---|---|---|---|
| | 0 - 20 | 21 - 40 | 41 - 60 | 61 - 80 | 81 - 100 |
| TONER DENSITY IN DEVELOPER(%) | 8.0 | 7.0 | 6.0 | 5.0 | 4.0 |

*FIG. 21*

| | TYPE OF PAPER | | |
|---|---|---|---|
| | ACID FREE PAPER | ACIDIC PAPER | RECYCLED PAPER |
| PAPER COEFFICIENT | 1.0 | 0.2 | 0.5 |

*FIG. 22*

| | DENSITY OF DOCUMENT COPIED FOR SPECIFIED NUMBER OF PAGES(%) | | | | |
|---|---|---|---|---|---|
| | 0 - 20 | 21 - 40 | 4 - 60 | 61 - 80 | 81 - 100 |
| DOCUMENT DENSITY COEFFICIENT | 1.0 | 0.8 | 0.6 | 0.4 | 0.2 |

*FIG. 23*

| | NUMBER OF COPIED PAGES FOR A TONER BOTTLE (in 10 thousands) | | | | |
|---|---|---|---|---|---|
| | less than 20 | 20 - 30 | 31 - 40 | 41 - 50 | 51 or more |
| TONER CONSUMED AMOUNT COEFFICIENT | 0.2 | 0.4 | 0.6 | 0.8 | 1.0 |

*FIG. 24*

| | RECYCLED TONER SUPPLYING RATE(%) | | | | |
|---|---|---|---|---|---|
| | 0 - 20 | 21 - 40 | 41 - 60 | 61 - 80 | 81 - 100 |
| PRE-TRANSFER CHARGER DC OUTPUT (KV) | 1.5 | 1.1 | 0.8 | 0.5 | OFF |
| LIGHT AMOUNT OF PRE-TRANSFER ERASER(Lux·Sec) | 5 | 10 | 20 | 30 | 40 |

*FIG. 25*

| | | RECYCLED TONER SUPPLYING RATE(%) | | | | |
|---|---|---|---|---|---|---|
| | | 0 - 20 | 21 - 40 | 41 - 60 | 61 - 80 | 81 - 100 |
| LED ON-OFF IN PRE-TRANSFER ERASER | LED1 | ON | ON | OFF | OFF | ON |
| | LED2 | OFF | OFF | ON | ON | ON |

*FIG. 28*

| DUTY (hexadecimal) | bit 1 | bit 2 | bit 3 | bit 4 | bit 5 | Resistance value(kΩ) |
|---|---|---|---|---|---|---|
| 00 | 0 | 0 | 0 | 0 | 0 | 25 |
| 01 | 0 | 0 | 0 | 0 | 1 | 50 |
| 02 | 0 | 0 | 0 | 1 | 0 | 75 |
| 03 | 0 | 0 | 0 | 1 | 1 | 100 |
| 04 | 0 | 0 | 1 | 0 | 0 | 125 |
| 05 | 0 | 0 | 1 | 0 | 1 | 150 |
| 06 | 0 | 0 | 1 | 1 | 0 | 175 |
| 07 | 0 | 0 | 1 | 1 | 1 | 200 |
| 08 | 0 | 1 | 0 | 0 | 0 | 225 |
| 09 | 0 | 1 | 0 | 0 | 1 | 250 |
| 0A | 0 | 1 | 0 | 1 | 0 | 275 |
| 0B | 0 | 1 | 0 | 1 | 1 | 300 |
| 0C | 0 | 1 | 1 | 0 | 0 | 325 |
| 0D | 0 | 1 | 1 | 0 | 1 | 350 |
| 0E | 0 | 1 | 1 | 1 | 0 | 375 |
| 0F | 0 | 1 | 1 | 1 | 1 | 400 |
| 10 | 1 | 0 | 0 | 0 | 0 | 425 |
| 11 | 1 | 0 | 0 | 0 | 1 | 450 |
| 12 | 1 | 0 | 0 | 1 | 0 | 475 |
| 13 | 1 | 0 | 0 | 1 | 1 | 500 |
| 14 | 1 | 0 | 1 | 0 | 0 | 525 |
| 15 | 1 | 0 | 1 | 0 | 1 | 550 |
| 16 | 1 | 0 | 1 | 1 | 0 | 575 |
| 17 | 1 | 0 | 1 | 1 | 1 | 600 |
| 18 | 1 | 1 | 0 | 0 | 0 | 625 |
| 19 | 1 | 1 | 0 | 0 | 1 | 650 |
| 1A | 1 | 1 | 0 | 1 | 0 | 675 |
| 1B | 1 | 1 | 0 | 1 | 1 | 700 |
| 1C | 1 | 1 | 1 | 0 | 0 | 725 |
| 1D | 1 | 1 | 1 | 0 | 1 | 750 |
| 1E | 1 | 1 | 1 | 1 | 0 | 775 |
| 1F | 1 | 1 | 1 | 1 | 1 | 800 |

0 : Hi (OFF)
1 : Low (ON)

NORMAL SETTING
DUTY: 04

*FIG. 29*

| | RECYCLED TONER SUPPLYING RATE(%) | | | | |
|---|---|---|---|---|---|
| | 0 - 20 | 21 - 40 | 41 - 60 | 61 - 80 | 81 - 100 |
| FRESH TONER REPLENISHING PATTERN | ① | ① | ② | ② | ③ |

*FIG. 30*

FRESH TONER REPLENISHING PATTERN ①

| | DIFFERENCE BETWEEN REFERENCE TONER DENSITY AND ATDC SENSOR OUTPUT VALUE (%) | | | | |
|---|---|---|---|---|---|
| | -1.0 | -0.5 | 0 | +0.5 | +1.0 |
| FRESH TONER REPLENISHING AMOUNT | HIGH | MEDIUM | MEDIUM | LOW | NONE |

FRESH TONER REPLENISHING PATTERN ②

| | DIFFERENCE BETWEEN REFERENCE TONER DENSITY AND ATDC SENSOR OUTPUT VALUE (%) | | | | |
|---|---|---|---|---|---|
| | -1.0 | -0.5 | 0 | +0.5 | +1.0 |
| FRESH TONER REPLENISHING AMOUNT | HIGH | MEDIUM | LOW | LOW | NONE |

FRESH TONER REPLENISHING PATTERN ③

| | DIFFERENCE BETWEEN REFERENCE TONER DENSITY AND ATDC SENSOR OUTPUT VALUE (%) | | | | |
|---|---|---|---|---|---|
| | -1.0 | -0.5 | 0 | +0.5 | +1.0 |
| FRESH TONER REPLENISHING AMOUNT | MEDIUM | MEDIUM | LOW | NONE | NONE |

FIG. 35
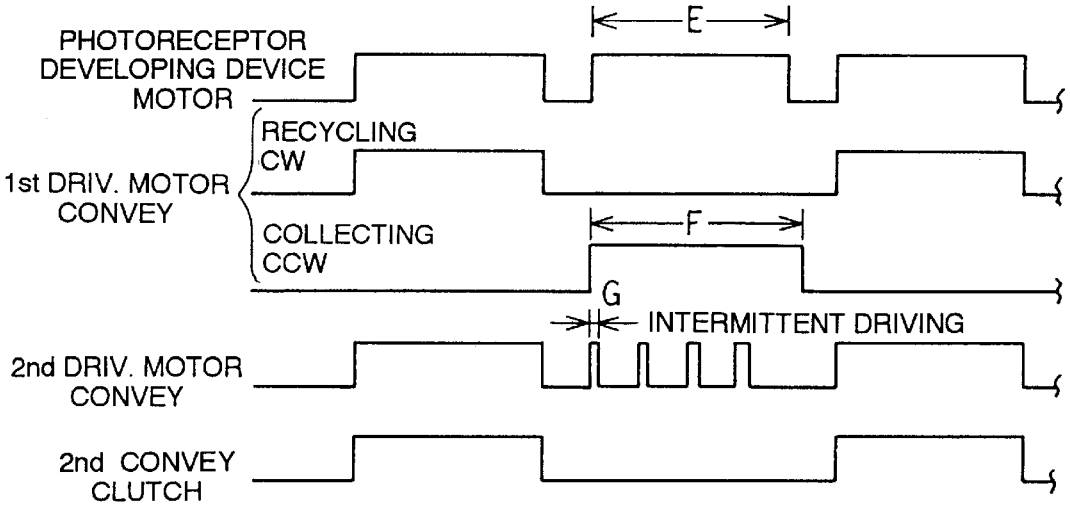
FIG. 36
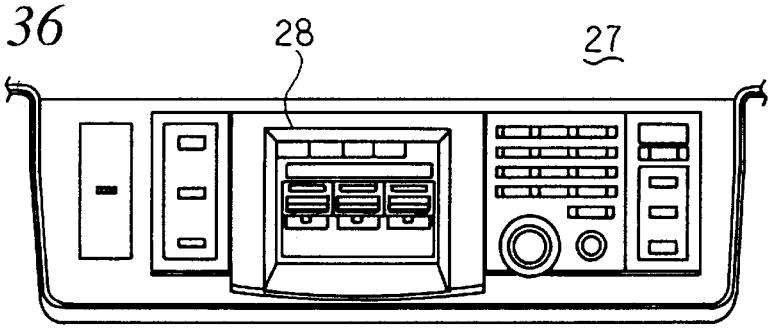
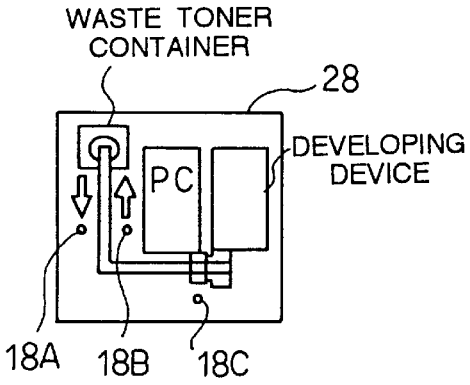
FIG. 37
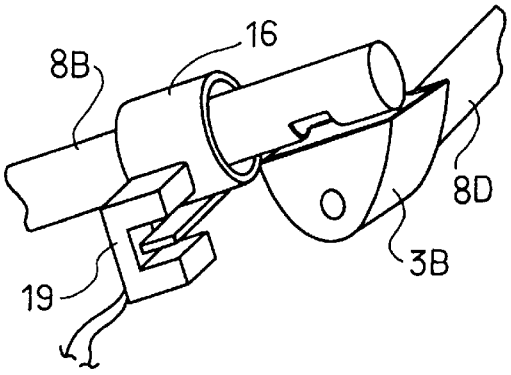
FIG. 38

IMAGE FORMING APPARATUS HAVING A FUNCTION FOR RECYCLING COLLECTED TONER AND CONTROL METHOD THEREOF

This application is based on Patent Applications Nos. 10-239114, 10-258220, 10-258221, 10-258222 and 10-258223 filed in Japan, the contents of which are hereby incorporated by reference.

BACKGROUND OF THE INVENTION

This invention relates generally to an image forming apparatus which is applied to a copier, a printer, a facsimile machine and the like.

Conventionally, an image forming apparatus has been provided wherein a developing unit develops a toner image by electrostatically supplying toner charged with electricity to an electrostatic latent image on an electrostatic latent image carrier (photoreceptor), and the developed toner image is transferred onto a sheet of paper so as to form an image. In this kind of the image forming apparatus, the toner remaining on the electrostatic latent image carrier after transferring the image is collected by a cleaning unit, and then, conveyed and returned into the developing unit for recycling (hereinafter, this process is referred to as toner recycling, and the toner to be reused is referred to as recycled toner).

As to the image forming apparatus which carries out the above-mentioned toner recycling, there has been proposed an art for changing a recycled toner supplying rate (a ratio between recycling and disposal of the collected toner) according to each of copy modes, controlling image forming conditions, or controlling the toner supplying rate according to a fog toner amount on a photoreceptor drum detected by a sensor, thereby preventing the degradation of the image quality (e.g. refer to Japanese Patent Gazette No. 2668527, Japanese Patent Examined publications Nos. 5-59428 and 4-54955, and U.S. Pat. No. 5,604,575).

The above Japanese Patent Gazette No. 2668527 discloses an apparatus which comprises a toner collecting chamber for containing collected toner, a toner container connected to a developing chamber, a toner re-supplying means for conveying the collected toner of the toner collected chamber into the toner container, and adjusts image forming conditions according to the number of image forming, thereby controlling the degradation of the image caused by change in toner properties associated with usage. Further, the Japanese Patent Examined publication No. 5-59428 discloses an apparatus which measures toner image density which remains on a photoreceptor, and controls the amount of toner to be replenished from a recycled toner and toner replenishing device into a developing unit based on the measured density value. Furthermore, the Japanese Patent Examined publication No. 4-54955 discloses an apparatus which has a conveyance passage for conveying collected toner into a developing unit and a collecting container, and varies a ratio of the recycled toner by a valve located in the conveyance passage, thereby decreasing a reducing ratio to 0 or value less than usual when the number of copied pages is less than the predetermined continuous number.

The U.S. Pat. No. 5,604,575 discloses an apparatus which comprises a first conveyer mechanism for conveying collected toner into a container, and then into a disposal part, and comprises a second conveyer mechanism for conveying the toner into a replenishing means, and an AIDC (auto image density control) sensor for detecting image density on a photoreceptor, and which selects a predetermined fresh toner/collected toner replenishing amount according to the detected value, thereby controlling the conveyer mechanism. Further, the U.S. Pat. No. 5,604,575 discloses an apparatus which comprises a controller for controlling the supplying rates of recycled toner and fresh toner, wherein the controller controls a recycled toner ratio to all the toner according to output of an ATDC sensor, and controls a toner replenishing amount according to output of an AIDC sensor, thereby decreasing the recycled toner replenishing amount, and increasing the fresh toner replenishing amount (toner density (a ratio between toner and carriers) is not changed in developer) when the developing ability is lowered.

Moreover, there has been known an art for using air force in order to collect toner powder sprinkled by rotation of a developing sleeve of a developing unit. In this art, however, the collected toner powder remains in and fills a toner suction duct, which prevents a stable operation for collecting toner powder, thereby making it impossible to maintain performance of the suction duct. Consequently, when the suction duct is filled with the toner powder, a user has to get a service person to replace the suction duct. Thus, it involves a troublesome maintenance.

Furthermore, there has been provided an art wherein, if an apparatus which has a mechanism for conveying and collecting the waste toner (toner to be disposed of), detects toner conveying torque and excessive load during a copying operation, the apparatus disables further copying operations, otherwise, the apparatus disables after making copies of specified pages following the detection of the excessive load, thereby preventing the degradation of the image quality (e.g., refer to Japanese Patent Gazette No. 2642353).

However, as to the above-mentioned recycled toner, since its degraded property prevents toner from being sufficiently charged with electricity (the toner which is insufficiently charged will be hereinafter referred to as undercharged toner), besides the recycled toner contains the undercharged toner which remained on the electrostatic latent image carrier without being transferred onto a transferred material (paper and the like), or contains powder generating from the paper being conveyed (hereinafter this powder is referred to as paper powder). If the undercharged toner or paper powder is re-supplied into the developing unit, the function does not sufficiently effect, which may cause ground fogging and contamination in the apparatus. This problem is more likely to occur as the toner density becomes higher. Besides, since adopting lower toner density produces an image having a decreased density, charging potential, developing bias and the like are set to be high potential, but this causes a problem such as carrier depositing, degradation of the image quality, leaking.

Moreover, the toner containing the undercharged toner or paper powder has decreased fluidity. Then, the toner is deposited on a blade and the like composing a conveyer mechanism, which increases the amount of toner solidified particles. If a user continuously makes copies in this state, the solidified toner is solidified in the conveyance pipe. Then, the solidified toner particles are conveyed into the developing unit, so that this will bring a problem of generating an image noise such as white and black spots. In a state that the solidified particles are generated, the user has to replace developer. This replacement operation consumes time, which produces inconvenience of making impossible for the user to make a copy during that time.

SUMMARY OF THE INVENTION

This invention is made to solve the above-mentioned problems. The first object of the present invention is to provide an image forming apparatus which controls reference toner density (reference level (target value) for controlling toner density at constant value) in developer according to a recycled toner supplying rate obtained by controlling a collected toner conveyer mechanism, thereby maintaining high image quality and simplifying a controller, and to provide a method thereof.

The second object of the present invention is to provide an image forming apparatus which can vary a recycled toner supplying rate according to image forming conditions, and enables stable images to be obtained.

The third object of the present invention is to provide an image forming apparatus which detects an image carrier surface for controlling recycled toner supplying rate so as to achieve an effective use of the recycled toner, thereby preventing degradation of the image quality which is caused by undercharged toner.

The fourth object of the present invention is to provide an image forming apparatus which selectively controls whether toner collected by a cleaning unit is conveyed into a developing unit or a waste toner container, and controls image transfer conditions according to recycling state of the toner, thereby allowing stable images to be obtained.

The fifth object of the present invention is to provide an image forming apparatus which can stably collect toner powder sprinkled around a developing unit, and dispose of the collected toner, thereby maintaining performance of the suction duct for the long term, and allowing a maintenance operation to be simplified.

The sixth object of the present invention is to provide an image forming apparatus wherein toner powder collected into a toner suction duct is disposed of, and toner collected by a cleaning unit is selectively recycled or disposed of according to image forming conditions, thereby performance of the suction duct can be maintained for the long term, and high quality images can be stably obtained.

The seventh object of the present invention is to provide an image forming apparatus which changes toner recycling rate according to conveyance load in a conveyer mechanism for conveying toner collected by a cleaning unit into a developing unit, or waste toner container, thereby decreasing the amount of toner solidified particles, and preventing an image noise caused by the toner solidified particles.

In order to achieve the above-mentioned objects, according to one aspect of the present invention, an image forming apparatus comprises: an image carrier; a developing device which develops an image onto said image carrier by developer; a developer supplying device which supplies the developer to said developing device; a cleaner which collects the developer on a surface of said image carrier; a conveyer mechanism which conveys the developer collected by said cleaner to either of a first part for disposal and a second part for supplying the collected developer to said developing device; and, a controller which controls operations of said conveyer mechanism and developer supplying device according to image forming conditions.

According to another aspect of the present invention, a control method in an image forming apparatus which collects developer on an image carrier so as to re-supply the collected developer to a developing device, comprises: a step of setting a ratio between recycling and disposal of the collected developer; and, a step of carrying out a control of toner density in the developer according to the said rate.

According to a further aspect of the present invention, an image forming apparatus comprises: an image carrier; a cleaner which collects developer on a surface of said image carrier; a conveyer mechanism which conveys the developer collected by said cleaner to either of a first part for disposal and a second part for recycling; a detector which detects conveyance load of said conveyer mechanism; and, a controller which controls operations of said conveyer mechanism according to said detection result.

BRIEF DESCRIPTION OF THE DRAWINGS

FIG. 9(*b*) is a flowchart explaining a toner recycling processing of the present invention.

FIG. 19 is a view of a specification table showing a relationship between the AIDC sensor detection value and the recycled toner supplying rate of the present invention.

FIG. 20 is a view of a specification table showing a relationship between the recycled toner supplying rate and the toner density in the developer of the present invention.

FIG. 21 is a view of a specification table showing coefficients of paper types of the present invention.

FIG. 22 is a view of a specification table showing coefficients of document density of the present invention.

FIG. 23 is a view of a specification table showing coefficients of toner consumed amounts of the present invention.

FIG. 24 is a view of a specification table showing a relationship between the recycled toner supplying rate and the transfer auxiliary output in the first and second embodiments of the present invention.

FIG. 25 is a view of a specification table showing a relationship between the recycled toner supplying rate and the pre-transfer eraser output in the third embodiment of the present invention.

FIG. 26(*b*) is a view of a conveying route in the second embodiment of the present invention.

FIG. 28 is a view of a duty setting table of an AIDC sensor control board of the present invention.

FIG. 29 is a view showing relationship between the recycled toner supplying rate and the fresh toner replenishing pattern of the present invention.

FIG. 30 is a view showing fresh toner replenishing patterns of the present invention.

FIG. 35 is a graph of a driving timing sequence in the fourth embodiment of the present invention.

FIG. 36 is a top view of an operation panel in the fourth embodiment of the present invention.

FIG. 37 is a view of a display example of an operation panel in the fourth embodiment of the present invention.

FIG. 38 is a perspective view of a shutter of a second conveyer mechanism in the fourth embodiment of the present invention.

DETAILED DESCRIPTION OF THE PREFERRED EMBODIMENT OF THE PRESENT INVENTION

Figure 1:
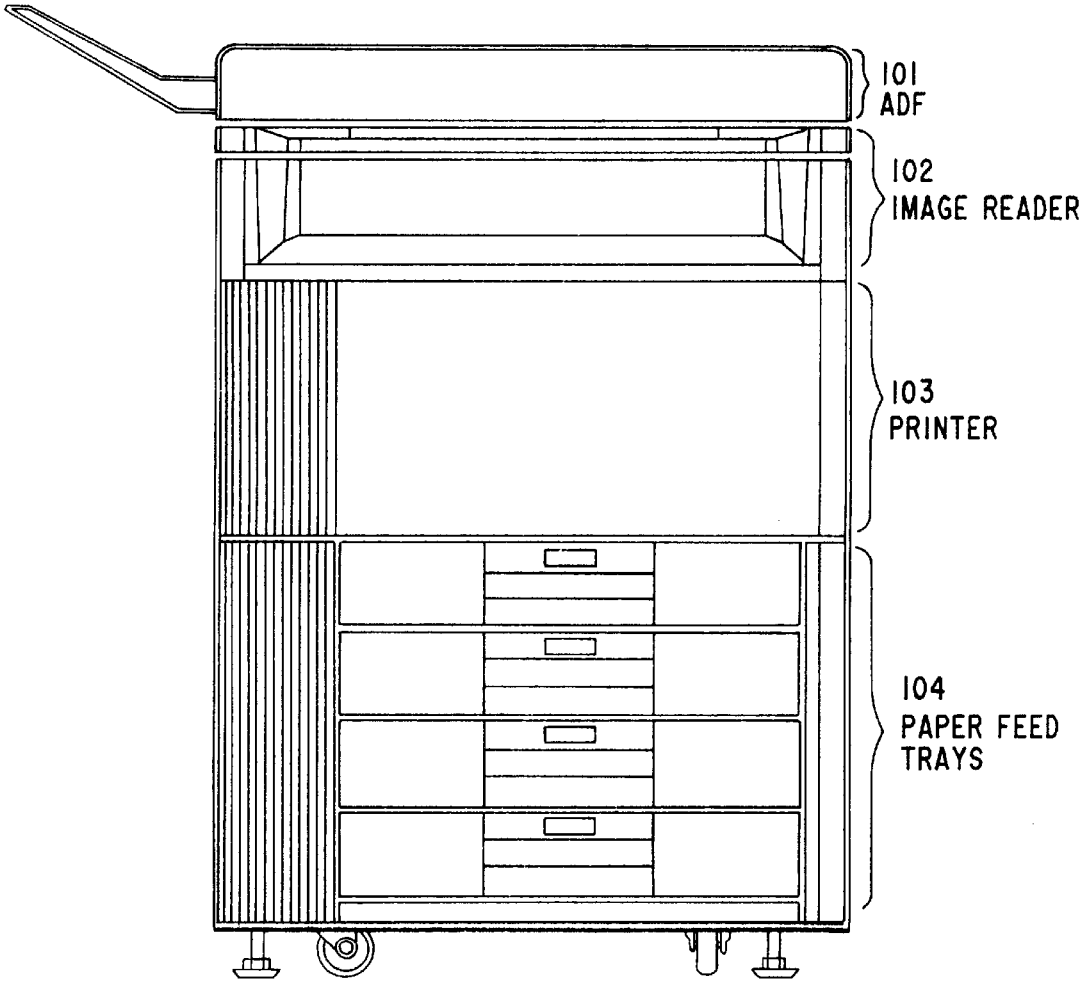
FIG. 1 is an external view of a copier machine as an example of an image forming apparatus of the present invention.
Figure 2:
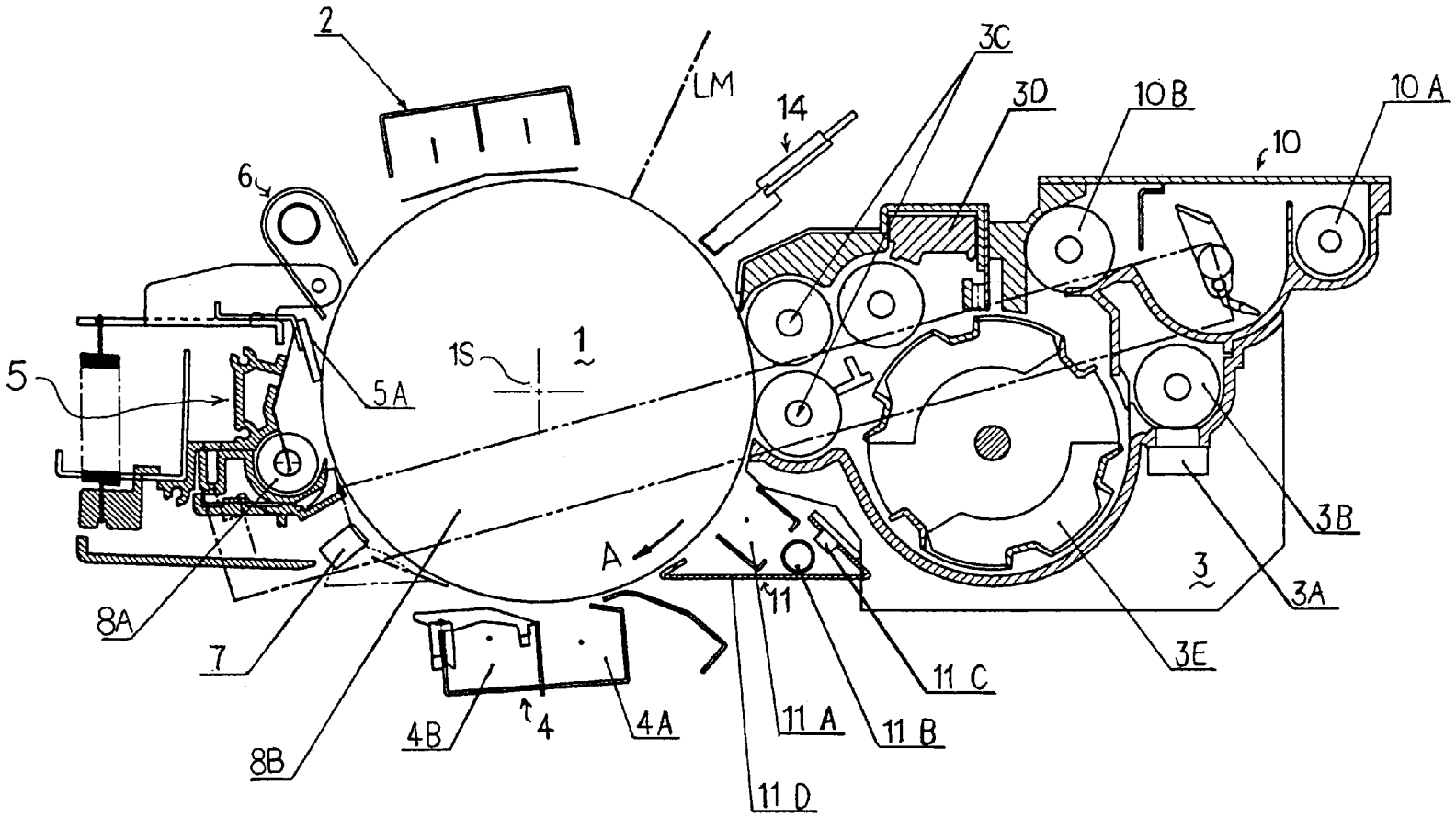
FIG. 2 is a structural view showing a processor of an image forming apparatus according to a first embodiment of the present invention.
Figure 3:
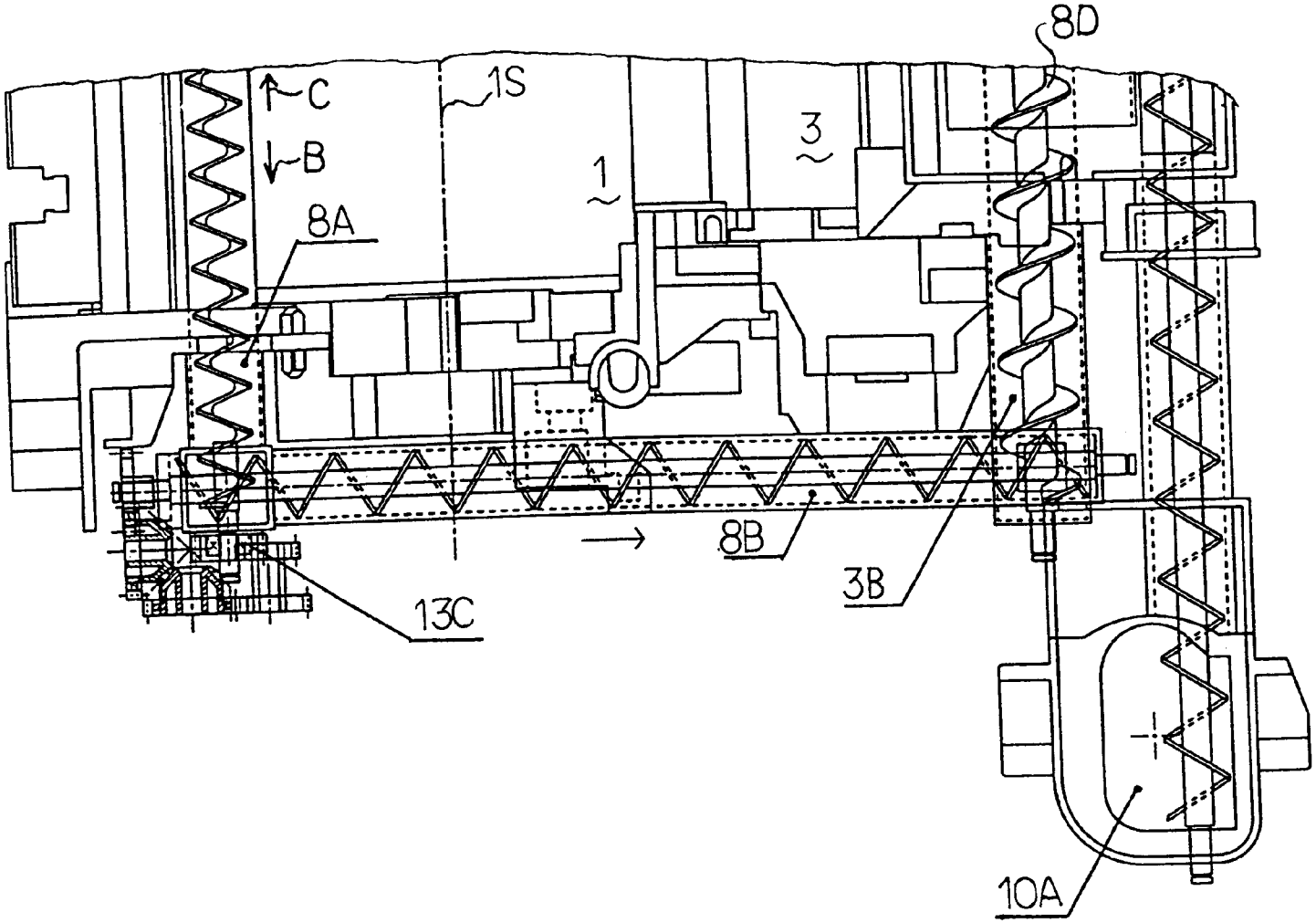
FIG. 3 is a top view showing a second conveyer mechanism of a recycling unit according to the first embodiment of the present invention.
Figure 4:
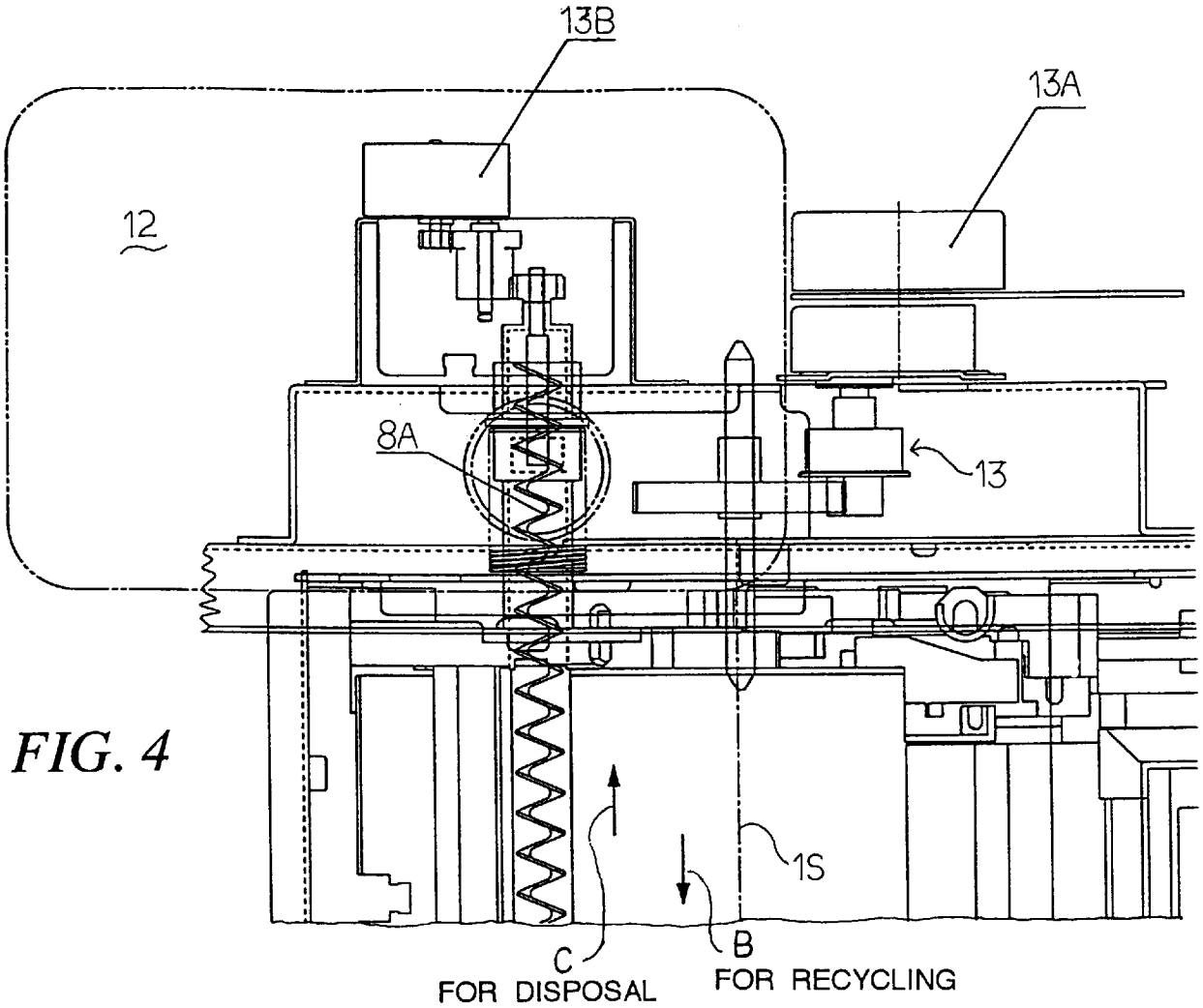
FIG. 4 is a top view showing a toner disposal section of the recycling unit according to the first embodiment of the present invention.

Now, the first embodiment of the present invention will be explained with reference to the drawings. This embodiment shows an image forming apparatus such as a copier or a printer using a well-known electrophotography process. FIG. 1 is a constitutional view showing an image forming apparatus to which the present invention is applied. The image forming apparatus shown in FIG. 1 includes an ADF (auto document feeder) 101, an image reader 102, a printer 103 and paper feed trays 104. The ADF 101 automatically feeds document to be read out by the image reader 102. The printer 103 includes a processor which forms an image of the read-out document. The paper feed trays 104 feed various sizes of sheets as an image transferred material. FIGS. 2 to 4 show a processor in the image forming apparatus according to the first embodiment of the present invention. As shown in the figures, the image forming apparatus includes a photoreceptor drum 1 (image carrier) which is provided with a photoreceptive layer around a perimeter thereof, and rotated around a drum spindle 1S in a direction of an arrow A by a driving motor 13A. Further, the image forming apparatus comprises an electrostatic charger 2, a developing unit 3 (developing device), and a transfer/separation unit 4. The electrostatic charger 2 charges a surface of the photoreceptor drum 1 with static electricity according to the rotation of the photoreceptor drum 1. A light beam (LM) from an exposure unit (not shown) discharges static electricity of the surface of the photoreceptor drum 1, thereby, toner is electrostatically absorbed into a charged electrostatic latent image by the developing unit 3. The transfer/separation unit 4 includes a transfer charger 4A for transferring the toner deposited on the photoreceptor drum 1 onto a sheet of paper (transferred material) fed from a paper feeding device (not shown), and includes a separation device 4B separates a toner-image transferred sheet from the photoreceptor drum 1. Then, a fixing unit (not shown) fixes the toner image on the sheet of paper. Also, the apparatus comprises a cleaning unit 5 (cleaner) for collecting the toner of about 10% remaining on the photoreceptor drum 1, and a main eraser 6 for erasing all of electrical charges from the surface of the photoreceptor drum 1 so as to prepare for a next copying operation. In addition, there is provided a transfer auxiliary device 11 upstream from the transfer/separation unit 4 in the drum rotational direction, and a side eraser 14 upstream from the developing unit 3, and also provided an AIDC sensor 7 for detecting fogging toner on the photoreceptor drum 1 upstream from the cleaning unit 5.

Figure 26B:
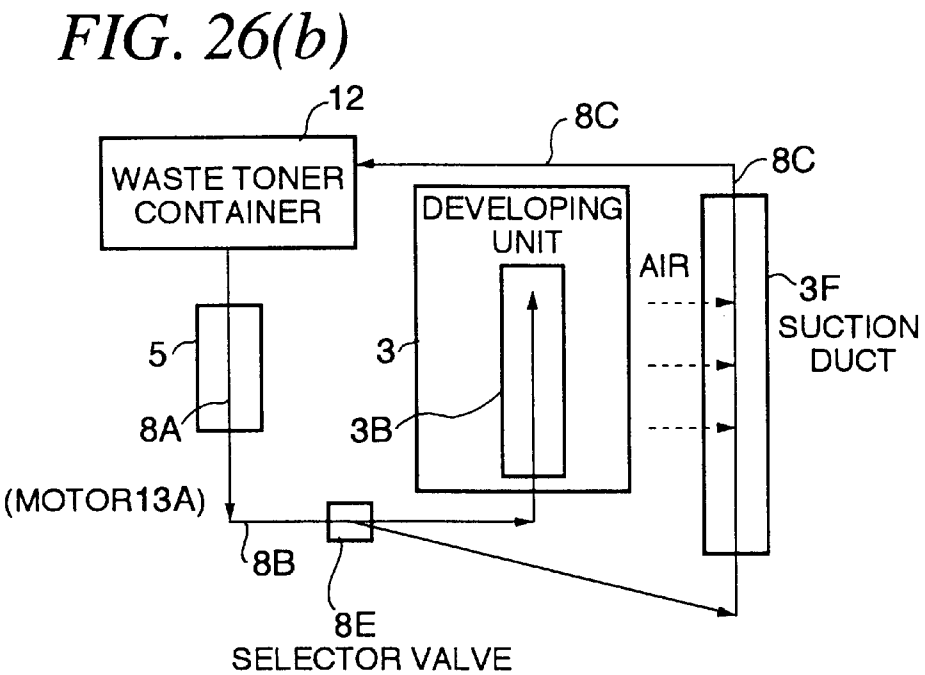
FIG. 26(*a*) is a view of a conveying route in the first embodiment of the present invention.
Figure 26A:
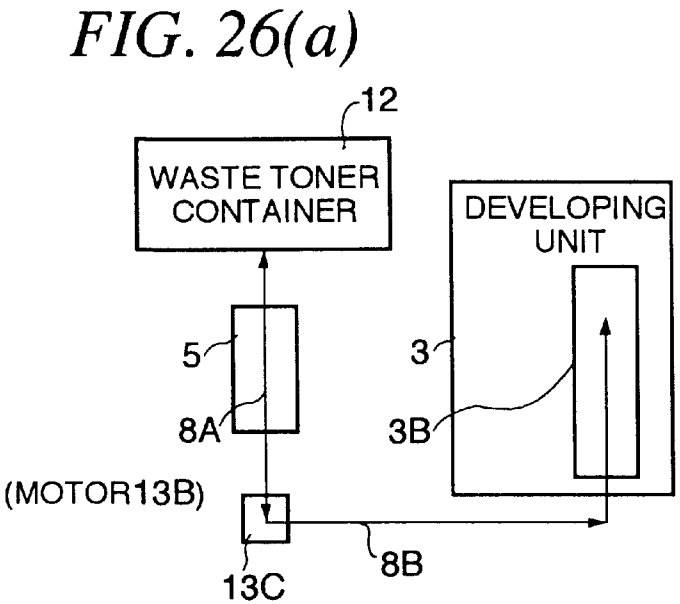

Next, the explanation is given to a recycling unit for selectively recycling the toner in the above-mentioned image forming apparatus. The recycling unit includes a first conveyer mechanism 8A and a second conveyer mechanism 8B for selectively conveying the toner collected by the cleaning unit 5 to a waste toner container 12 (first part) or a recycled toner supplying inlet 3B (second part, including a toner hopper and a developing device) of the developing unit 3. The photoreceptor drum 1 and developing unit 3 are driven by a driving motor 13A of a driving unit 13. The first and second conveyer mechanisms 8A and 8B are driven by a driving motor 13B which is different from the driving motor 13A. In response to the rotation in the normal or reverse direction of the driving motor 13B, the first and second conveyer mechanisms 8A and 8B dispose of (arrow C direction in FIG. 3) or recycle (arrow B direction) the toner collected by the cleaning unit 5. The first and second conveyer mechanisms 8A and 8B share a driven coupling part (FIG. 3) which is provided with a one-way clutch 13C so as not to transmit a driving force in order to prevent a toner conveyance route from being blocked with toner in a toner disposal operation. A route for disposing of or recycling the collected toner in the recycling unit according to the first embodiment is shown in FIG. 26(*a*). As the conveyer mechanism, a spiral member which is rotatably driven can be employed.

Figure 5:
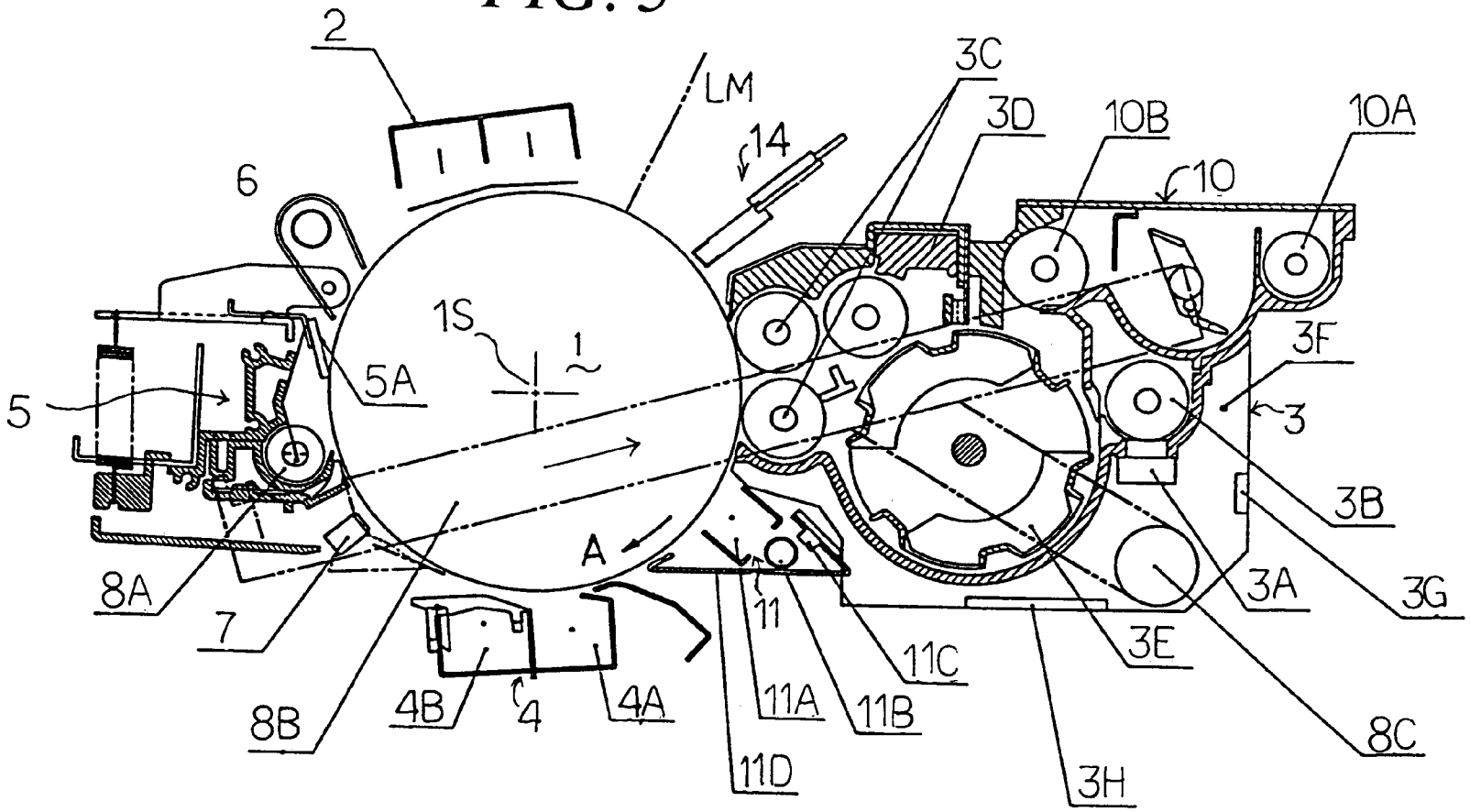
FIG. 5 is a structural view showing a processor of an image forming apparatus according to a second embodiment of the present invention.
Figure 6:
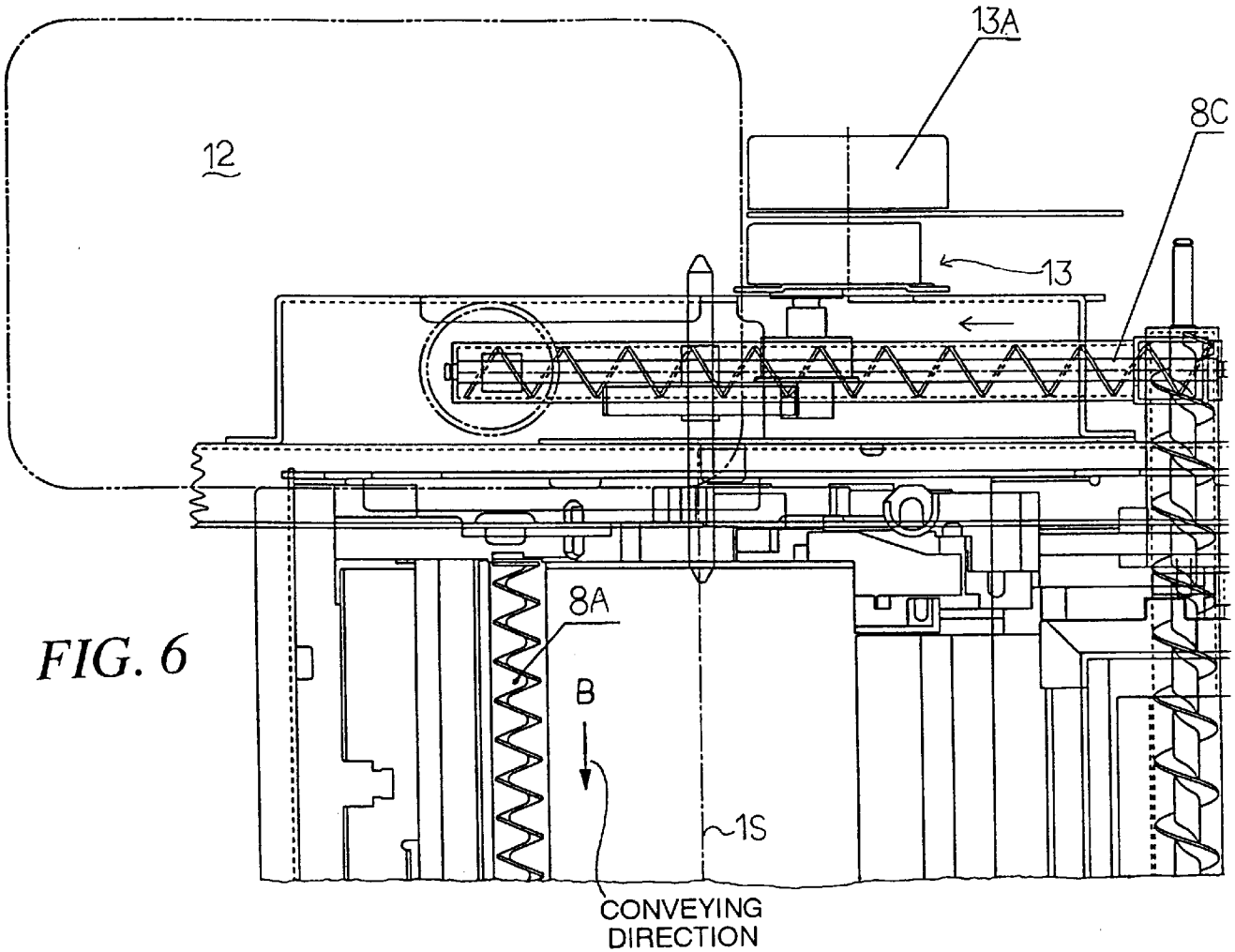
FIG. 6 is a top view showing a toner disposal unit of a recycling unit according to the second embodiment of the present invention.

FIGS. 5 and 6 show a processor of the image forming apparatus according to the second embodiment of the present invention. Although the processor is structured as in the case of the above-mentioned first embodiment, a toner recycling unit is differently structured. The toner recycling unit includes a third conveyer mechanism 8C for conveying the collected toner to the waste toner container 12 (first part), and a toner suction duct 3F (its side is shown in the figure) for sucking in powder of undercharged toner sprinkled by a rotation of a magnetic brush 3C provided in a lower part of the developing unit 3. The first and second conveyer mechanisms 8A and 8B are rotatably driven by the driving motor 13A which drives the photoreceptor drum 1 and developing unit 3 only in a direction (arrow B direction in FIG. 6) for conveying the toner from the cleaning unit 5 into the developing unit 3 for recycling. The second conveyer mechanism 8B has a selector valve 8E (FIG. 26(*b*)) in the middle of the conveyer route thereof. When the valve 8E is changed over, the recycled toner is selectively conveyed into the recycled toner supplying inlet 3B (second part) of the developing unit 3, or conveyed into a toner disposal inlet (connected to the third conveyer mechanism 8C) which is provided in the toner suction duct 3F for collecting the undercharged toner with air force by a rotation of the magnetic brush 3C.

Figure 17:
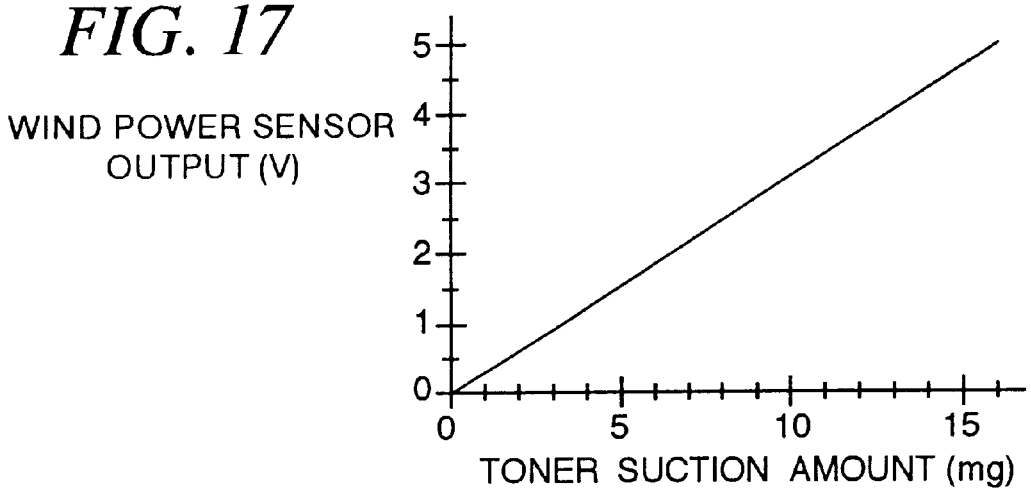
FIG. 17 is a graph of a relationship between the toner suction amount and the wind power sensor output of the present invention.
Figure 18:
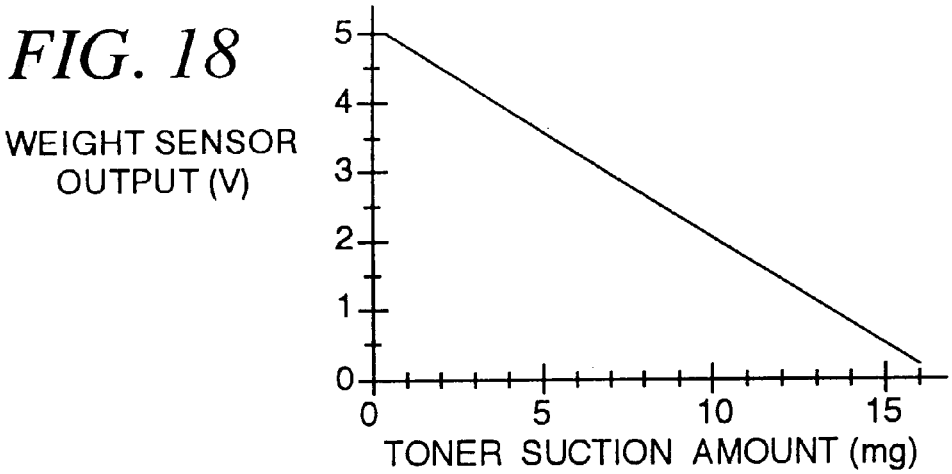
FIG. 18 is a graph of a relationship between the toner suction amount and the weight sensor output of the present invention.

The toner suction duct 3F includes a wind power sensor 3G, a weight sensor 3H, and the third conveyer mechanism 8C for conveying the toner into the waste toner container 12. The relationship between outputs from the wind power sensor 3G and weight sensor 3H, and the toner suction amount are shown in FIGS. 17 and 18. The third conveyer mechanism 8C conveys the toner collected by air force together with the recycled toner into the waste toner container 12, before the sensor detects the decreasing of the toner sucking power, when a specified amount of toner is accumulated in the toner suction duct 3F, or when the number of copied pages counted by an electronic counter (not shown) reaches a predetermined number. A route for disposing of or recycling the collected toner in the recycling unit according to the second embodiment is shown in FIG. 26(*b*).

As mentioned above, the wind power sensor 3G, the weight sensor 3H or the like detects the amount of toner powder which is collected into the toner suction duct 3F. Then, the toner powder is conveyed into the waste toner container 12 in response to the detected amount, so that the suction duct 3F may not be filled with the toner powder, which makes it possible to stably collect the toner powder, and maintain performance of the suction duct in the apparatus.

A later-describe microcomputer 21 (FIG. 8) controls the first and second conveyer mechanisms 8A and 8B according to image forming conditions. As a result of the controlling, according to a recycling rate of the collected toner, the microcomputer 21 controls image transferring conditions by transfer means such as the transfer charger 4A or a later-described transfer auxiliary device.

The first and second conveyer mechanism are controlled by a controller including a later-described microcomputer 21 (FIG. 8) according to image forming conditions and results detected by a later-described AIDC (auto image density control) sensor and the like, by which, the collected toner is recycled at an optimum recycling rate.

Now, the explanation is given to the developing unit 3 conveniently using two-element developer consisting of toner and carriers. The developing unit 3 is provided with the recycled toner supplying inlet 3B, a bucket roller 3D, a magnetic brush 3C, a regulating blade 3D, the ATDC sensor 3A and a conveyer screw 8D. The recycled toner supplying inlet 3B lets in the recycled toner in response to a later-described recycled toner supplying rate (a ratio between recycling and disposal of the collected toner). The bucket roller 3D charges the toner of the developer with electricity. The magnetic brush 3C supplies the toner to an electrostatic latent image on the photoreceptor drum 1. The regulating blade 3D regulates the amount of the developer which is conveyed into the magnetic brush 3C. The ATDC (auto toner density control) sensor 3A detects toner density (a ratio between toner and carriers) of the developer in the developing unit 3. Further, the developing unit 3 is provided in an upper part thereof with a sub-hopper 10, and a toner remaining detection sensor (not shown), and a toner replenishing roller 10B. The sub-hopper 10 replenishes fresh toner. The toner remaining detection sensor detects the remaining amount of the toner in the sub-hopper 10. The replenishing roller 10B replenishes the fresh toner into the developing unit 3. In response to value detected by the ATDC sensor 3A, the fresh toner is replenished to the developing unit 3 from the sub-hopper 10. Also, in response to value detected by the toner remaining detection sensor, the fresh toner is supplied into a fresh toner supplying inlet 10A of the sub-hopper 10 from a toner bottle (not shown).

Figure 31:
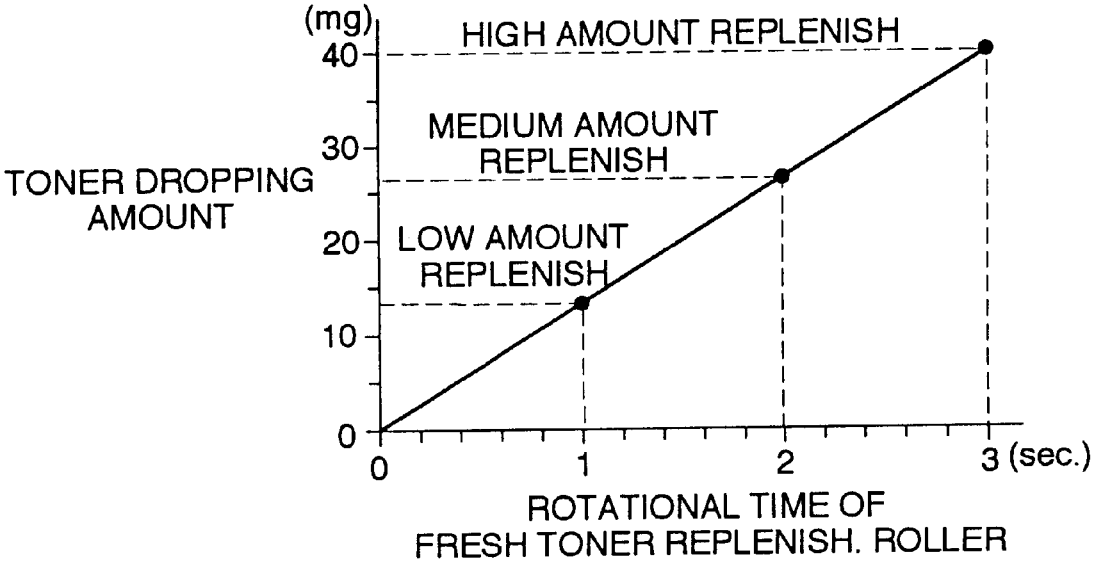
FIG. 31 is a graph of relationship between the rotational time of a fresh toner replenishing roller and the toner dropping amount of the present invention.

The amount of the fresh toner which is replenished from the toner replenishing roller 10B of the sub-hopper 10 to the developing unit 3 is set in four stages (low amount, medium amount, high amount and none) based on a difference between the detection value of the ATDC sensor 3A and the reference toner density, as shown in FIGS. 29, 30 and 31. The fresh toner amount is controlled according to rotational time of the fresh toner replenishing roller 10B.

Before or during a copying operation, an AE (auto exposurer) sensor (not shown) or the image processor detects the document density (B/W (black-to-white) ratio, and dot-counted value); and then, based on the detected value, it predicts (calculates) the amount of collected toner while carrying out a copying operation, and predicts (calculates) time for conveying the collected toner from the first conveyer mechanism to the developing unit 3 through the second conveyer mechanism. When it reaches the predicted (calculated) time (at the same time that the toner is conveyed into the recycled toner supplying inlet 3B of the developing unit 3), a fresh toner replenishing pattern is selected according to the recycled toner supplying rate, thereby, the toner density in the developer and recycled toner contained rate can be maintained at fixed value. For example, if the recycled toner supplying rate is determined to be 85%, a fresh toner replenishing pattern is ③ in FIG. 30 for the predetermined number of pages until the next calculation conditions. Following it, the recycled toner supplying rate is determined to be 45% as a result of a calculation for the predetermined number of pages, ② in FIG. 30 is selected as a fresh toner replenishing pattern.

Figure 15:
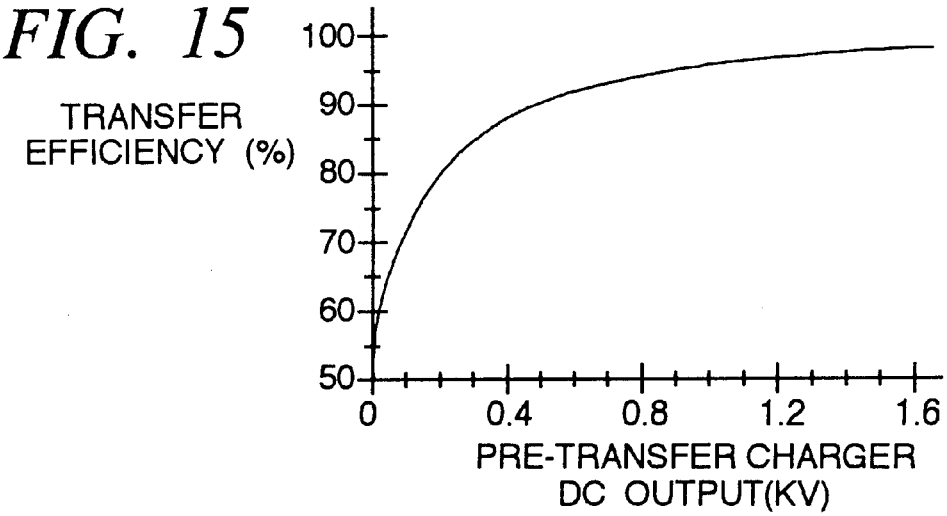
FIG. 15 is a graph of a relationship between the pre-transfer charger output and the transfer efficiency of the present invention.
Figure 16:
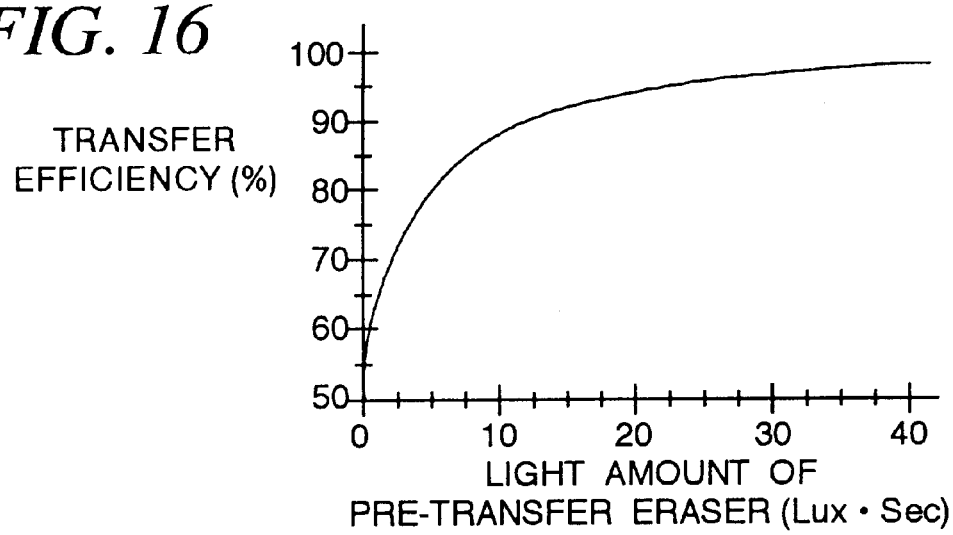
FIG. 16 is a graph of a relationship between the light amount of a pre-transfer eraser and the transfer efficiency of the present invention.

Next, the explanation is given to the transfer auxiliary device 11. As shown in FIGS. 2 and 5 for the first and second embodiments, the transfer auxiliary device 11 is composed of a pre-transfer charger 11A, a pre-transfer eraser 11B, a light amount detecting sensor 11C, and a guide member 11D. The pre-transfer charger 11A applies AC+DC bias voltage by means of the corotron method, and charges the toner image on the photoreceptor drum 1 with electricity of the same polarity as the toner (FIG. 15). The pre-transfer eraser 11B attenuates the electricity charged on the photoreceptor drum 1 and decreases absorptive force between the photoreceptor drum 1 and the toner image on the photoreceptor drum 1 so as to enhance the transfer effectiveness (FIG. 16). Further, the pre-transfer eraser 11B decreases absorptive force between the photoreceptor drum 1 and a sheet of paper such that a separation device 4B may easily separate the sheet. Furthermore, the pre-transfer eraser 11B is arranged together with the light amount detecting sensor 11C for regulating voltage of a power source in response to the value detected by the sensor 11C so as to maintain the light amount.

Figure 8:
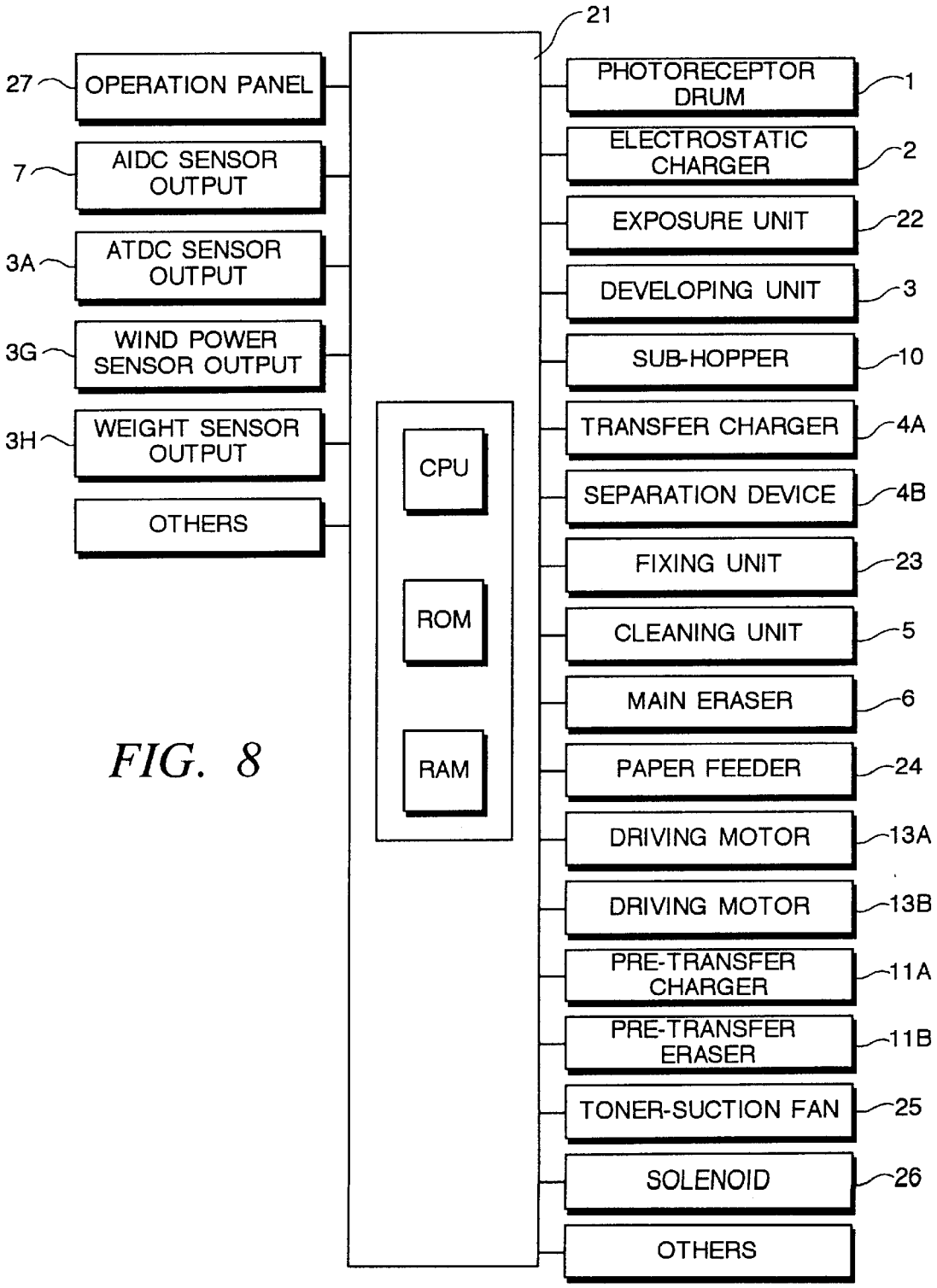
FIG. 8 is a block diagram showing a controller of the present invention.

FIG. 8 shows a block diagram of the controller of the image forming apparatus according to the present invention. In the figure, a microcomputer 21 is provided with a CPU (central processing unit), a ROM (read only memory), and a RAM (random access memory) which act as a controller. The microcomputer 21 is connected to members having various functions such as an exposure unit 22, a fixing unit 23, a toner-suction fan 25, a solenoid 26 and a operation panel 27, in addition to the above-mentioned photoreceptor drum 1 and electrostatic charger 2.

Figure 9A:
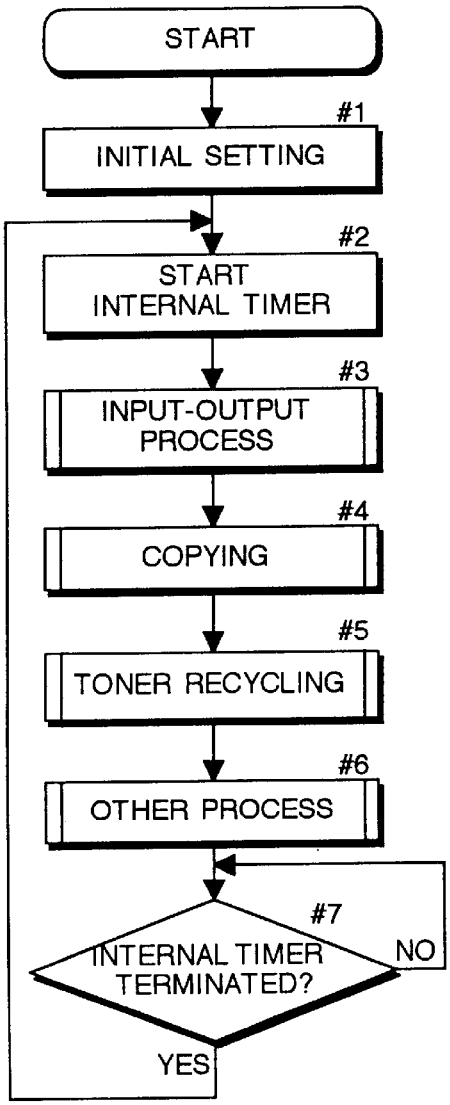
FIG. 9(*a*) is a flowchart explaining an entire control according to the image forming apparatus of the present invention.
Figure 9B:
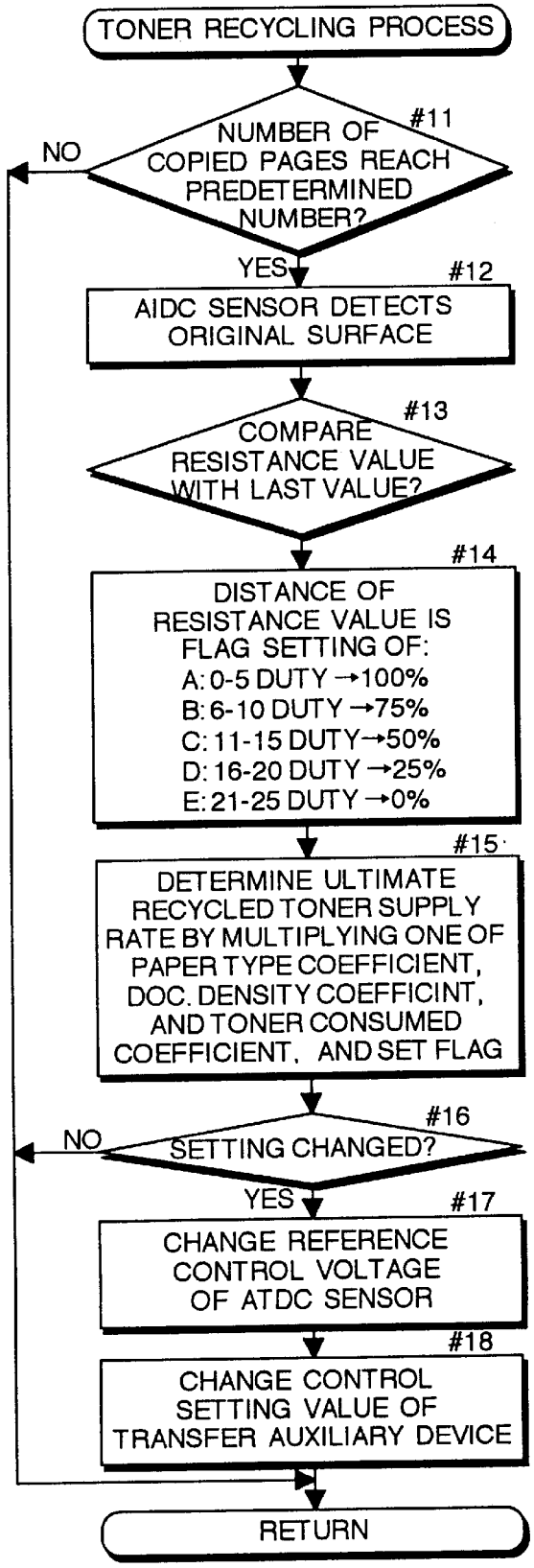

FIG. 9(*a*) is a flowchart of an entire processing executed by the microcomputer 21. After an initial setting (#1) and an internal timer starting (#2), the microcomputer 21 carries out an input-output process (#3), a copying process (#4), a toner recycling process (#5), and other process (#6). When the internal timer is terminated (#7), the procedure returns to step #2 for repeating the above-mentioned process. Thus, the toner recycling process is carried out every at predetermined periods, which allows an appropriate recycling operation.

Figure 14:
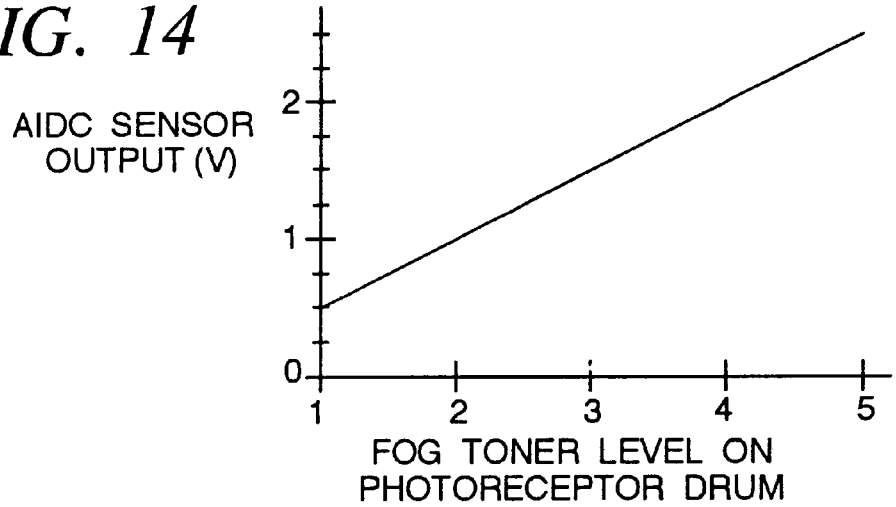
FIG. 14 is a graph of a relationship between the fog toner level on the photoreceptor drum and the AIDC sensor output of the present invention.

FIG. 9(*b*) is a flowchart of the toner recycling process. Hereafter, the control for determining the recycled toner supplying rate will be explained. After finishing the copying operation when the number of the copied pages reaches a predetermined number (#11), the microcomputer 21 commands the AIDC sensor 7 located in the lower part of the cleaning unit 5 to detect fog toner on the photoreceptor drum 1 (#12). A relationship between outputs from the AIDC sensor 7 and fog toner levels is shown in FIG. 14. The fog toner is detected as follows. In an original surface of the photoreceptor drum 1 (a state that toner is not yet developed), a fixed amount of current is applied to the AIDC sensor 7, and resistance value on a control board of the AIDC sensor 7 is selected so as to maintain the sensor output at constant voltage, then the selected resistance value and the previously-selected resistance value are compared (#13). After that, according to a difference between these resistance values, value for setting the recycled toner supplying rate is selected as shown in FIG. 19 (#14). For example, there is provided a table of resistance value in a control board of the AIDC sensor as shown in FIG. 28. It is assumed that the resistance value is duty of "04", and the recycled toner supplying rate is 100% in a normal setting. As described above, after the copying operation for specified number of pages is finished, if a fog detection is carried out, and a selection is made for duty of "0B" which holds the AIDC sensor output at a constant voltage value, there exists a difference of 7 duty (=OB–04 (hexadecimal number)) in resistance value. The previously-determined recycled toner supplying rate (FIG. 19) is changed from 100% to 75% (#14). Further, if the fog detection is again carried out after another copying operation for specified number of pages, and a selection is made for duty of "1A", the resistance value difference becomes 22 duty (=1A–04 (hexadecimal number)), and the recycled toner supplying rate is changed to 0%. The setting of the recycled toner supplying rate is executed by a flag setting.

Further, the microcomputer 21 determines an ultimate recycled toner supplying rate (recycled toner supplying rate employed in a copying operation, i.e., rate of collected toner in the toner to be supplied to the developing apparatus) according to various kinds of the image forming conditions explained below (#15). That is, the ultimate recycled toner supplying rate is determined by multiplying the recycled toner supplying rate selected by the AIDC sensor 7 by at least one of the following coefficients: a coefficient shown in FIG. 21 which is set according to types of paper (acidic paper, acid-free paper, recycled paper and so on) which is inputted from the operation panel 27 to the microcomputer 21; a coefficient shown in FIG. 22 which is set according to total document density for predetermined number of copied pages detected by a document density detecting sensor (not shown) located inside the exposure unit 22; and a coefficient shown in FIG. 23 which is set according to calculated value of the amount of consumed toner determined by a detector for detecting the number of copied pages for a bottle containing fresh toner.

For example, when the recycled toner supplying rate is 75%, and the paper coefficient is 0.5, the microcomputer 21 determines the ultimate recycled toner supplying rate to be 37.5% (=75%×0.5). Also, when the recycled toner supplying rate is 50%, the paper coefficient is 1.0, the document density coefficient is 0.8, and the coefficient of the consumed toner amount is 0.6, the microcomputer 21 determines the ultimate recycled toner supplying rate to be 24% (=50%×1.0×0.8×0.6). The ultimate recycled toner supplying rate is determined according to the above-mentioned various kinds of the image forming conditions. The flag is set so as to decrease the recycling rate when the image forming condition exceeds a certain reference level in which degradation of the recycled toner is considered.

Moreover, in addition to the case of the copying operation, in the case of forcible replenishment of the toner which is inputted from the operation panel 27, in the case of drum drying operation (refresh mode of the photoreceptor drum 1), in the case of stopping the copying operation so as to forcibly replenish the toner when the toner density in the developer is extremely decreased in the copying operation, or in the case of a management for decreasing copying productivity (CPM) in order to secure the fixing performance, the recycled toner supplying rate is increased above the ultimate recycled toner supplying rate (e.g., changed from 50% to 75%) or toner is fully recycled because the developing unit 3 is forcibly driven, or the driving time is prolonged, which enhances the charging ability of the toner in the developing unit 3.

Figure 10:
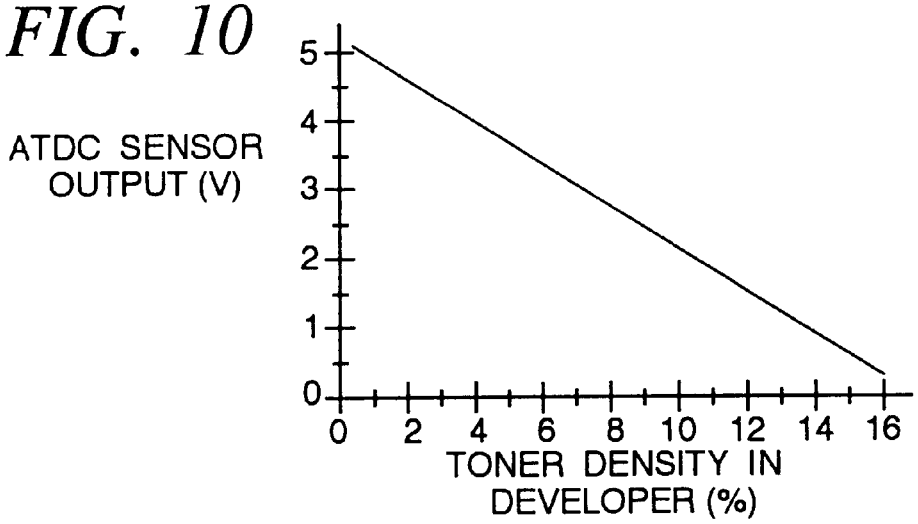
FIG. 10 is a graph of a relationship between the toner density in developer and the ATDC sensor output of the present invention.
Figure 11:
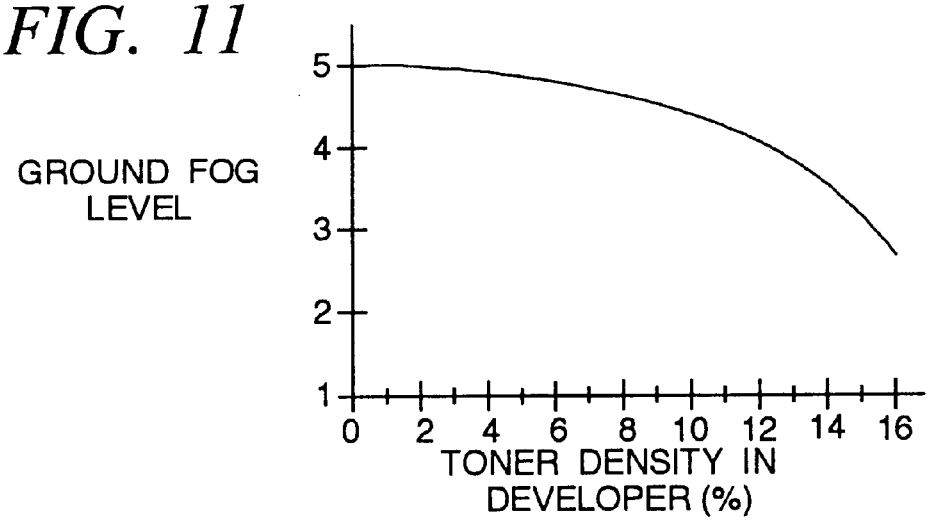
FIG. 11 is a graph of a relationship between the toner density in developer and the ground fog level of the present invention.
Figure 12:
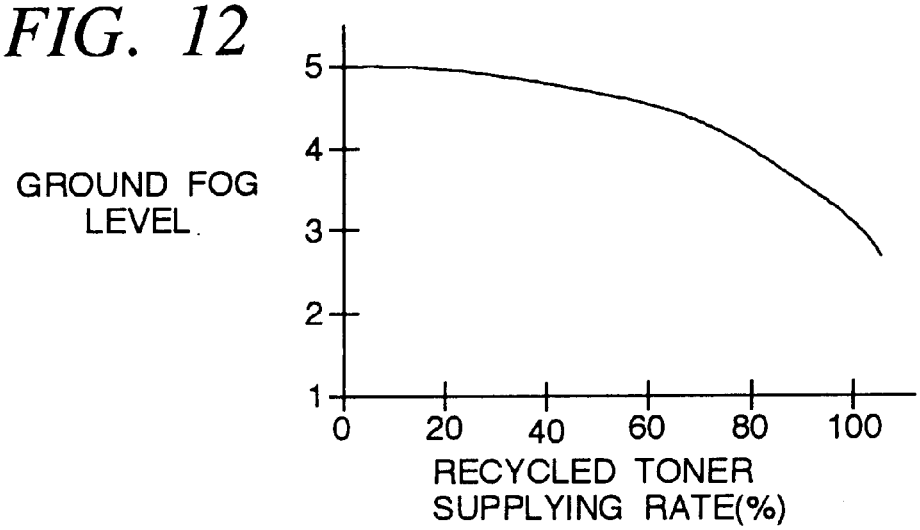
FIG. 12 is a graph of a relationship between the recycled toner supplying rate and the ground fog level of the present invention.
Figure 13:
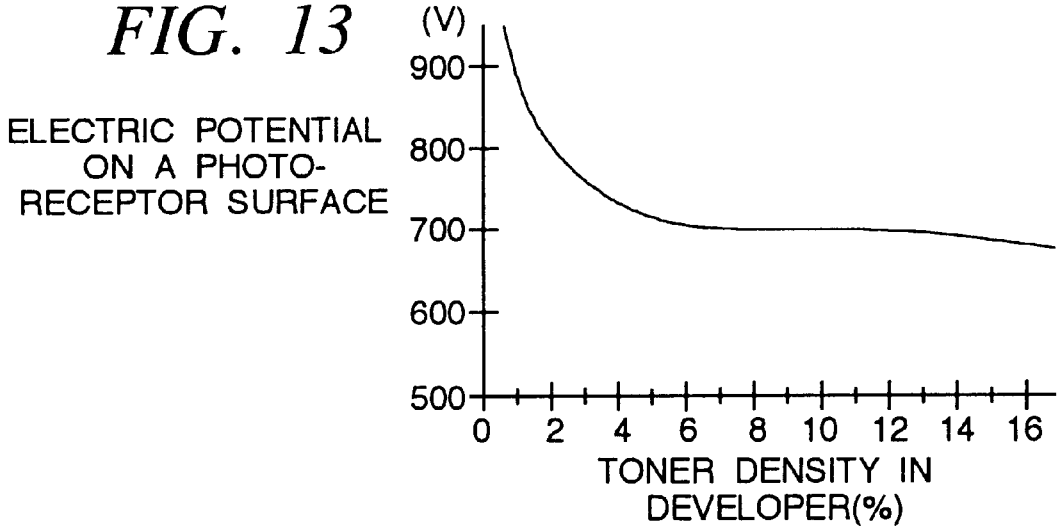
FIG. 13 is a graph of a relationship between the toner density in developer and the electric potential for reserving image density on a drum surface of a photoreceptor in the present invention.
Figure 27:
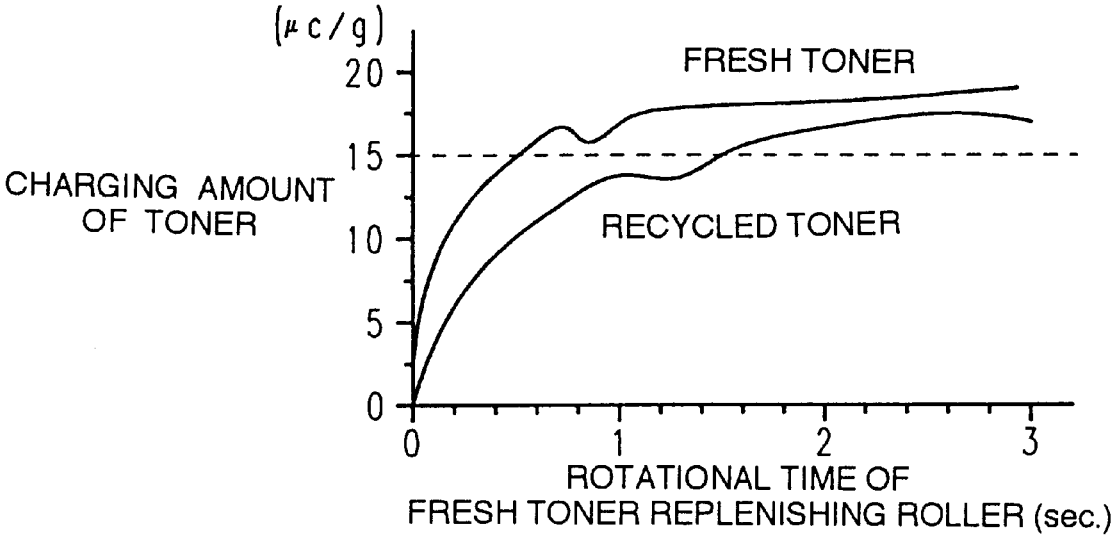
FIG. 27 is a view of a rising characteristic in electricity charging of toner of the present invention.

As shown in FIG. 10, the above ATDC sensor 3A increases its output as the toner density in the developer is decreased, so that the ATDC sensor 3A can be controlled so as to replenish the toner when the sensor output voltage becomes higher relative to a certain reference voltage of the sensor. A relationship of ground fog levels with the toner density in the developer and recycled toner supplying rate is as shown in FIGS. 11 and 12. A relationship between the toner density in the developer and potentials on the photoreceptor surface which maintains the image having the fixed density is shown in FIG. 13. When the recycled toner supplying rate is low, or when the toner density in the developer is high, although it is possible to set a low charging potential because of a high developing ability, there occurs a problem of fogging the ground and sprinkling toner powder. On the other hand, when the recycled toner supplying rate is high, or when the toner density in the developer is low, it is required to set a high charging potential because of a low developing ability, which causes a problem of leaking or degradation of the image quality. However, remarkable degradation of the properties of the recycled toner is caused by a rising characteristic of charging as shown in FIG. 27. If the recycled toner is well stirred, the toner can be charged with electricity so as to be consistent with the developing performance. However, it is difficult to achieve it in a developing device having a structure such as a high-speed image forming device which stirs toner in a short time.

Therefore, as shown in FIG. 20, low toner density in developer is set for high recycled toner supplying rate such that carriers and recycled toner may easily contact with each other, thereby enhancing charging efficiency. On the other hand, the high toner density in developer is set for low recycled toner supplying rate such that carriers and recycled toner may not easily contact with each other, and in order to reduce a charging amount of toner, the reference control voltage of the ATDC sensor 3A is changed according to the recycled toner supplying rate (YES at #16 and #17 in FIG. 9(*b*)), thereby, the reference toner density in the developer is controlled. Due to this control, optimum parameters of the developer unit 3 can be set. Further, since the abrupt change of the toner density produces an unsteady image quality, the amount of changing the toner density at a time is limited.

Moreover, operations of the transfer auxiliary device 11 are explained. As mentioned above, although the transfer auxiliary device 11 has a function for enhancing the transfer efficiency and separation performance, if fog toner exists on the photoreceptor drum 1, the fog toner charged with electricity is also transferred to a sheet, which produces a copied sheet having a soiled ground. To solve this problem, setting value of controlling the transfer auxiliary device 11 is changed according to the recycled toner supplying rate (#18). That is, as shown in FIG. 24, when the recycled toner supplying rate is high, the setting is made for lowering output value of the pre-transfer charger 11A or turning off the pre-transfer charger 11A so as to increase the light amount of the pre-transfer eraser 11B. On the other hand, when the recycled toner supplying rate is low, the setting is made for increasing the output value of the pre-transfer charger 11A, and decreasing the light amount of the pre-transfer eraser 11B. The selective change of the setting value prevents the transfer of the fog toner onto the sheet.

Figure 7:
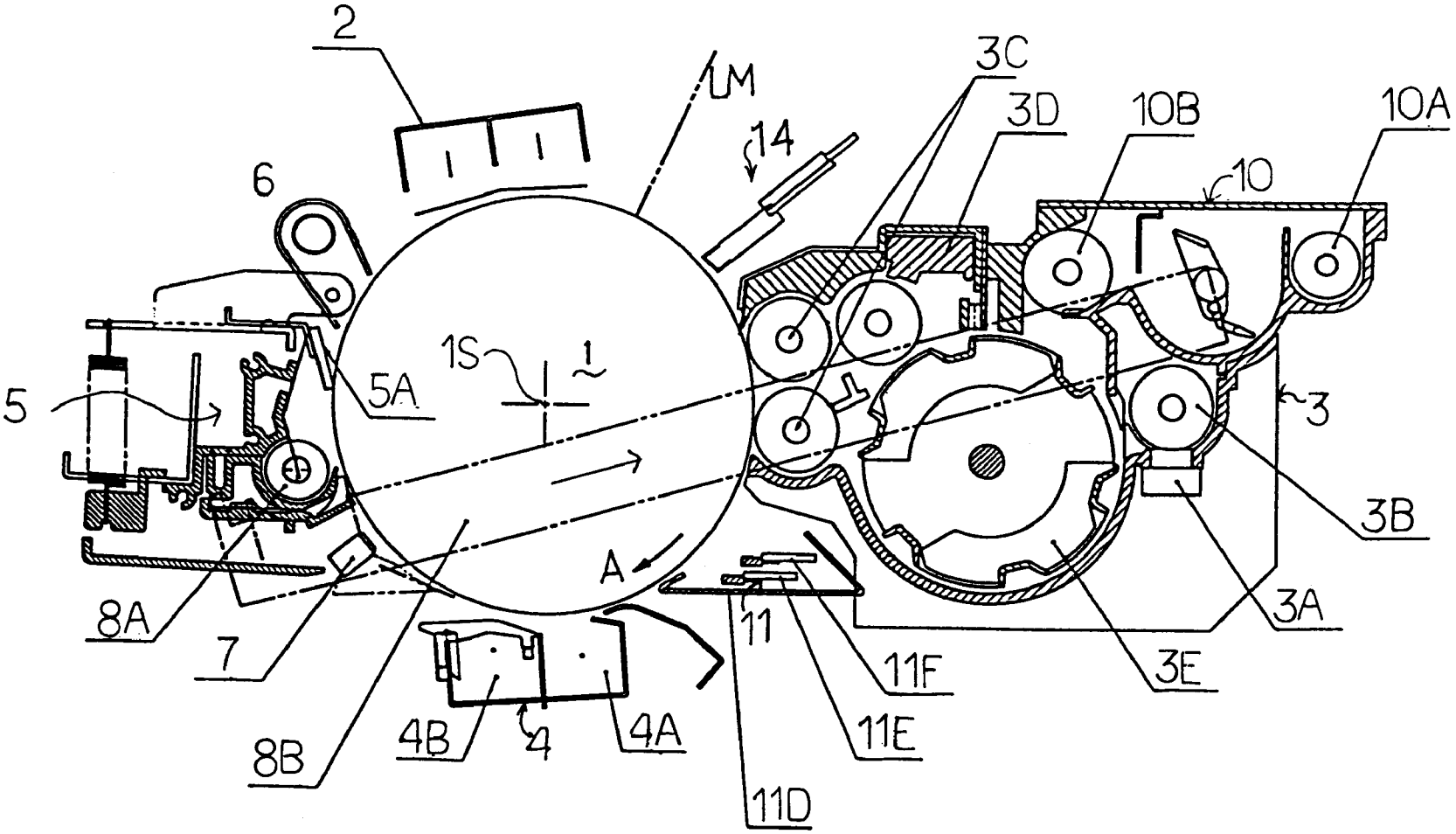
FIG. 7 is a structural view showing a processor of an image forming apparatus according to a third embodiment of the present invention.

FIG. 7 shows a processor of the image forming apparatus according to the third embodiment of the present invention. The processor of the third embodiment differs from that of the first embodiment only in the transfer auxiliary device 11, and does not include the pre-transfer charger 11A and light amount detecting sensor 11C, but includes pre-transfer erasers 11E (LED1) and 11F (LED2) composed of LED arrays. The pre-transfer eraser 11F has a higher brightness than the eraser 11E has. As shown in FIG. 25, when the recycled toner supplying rate is high, both of the pre-transfer erasers 11E and 11F illuminate so as to increase the light amount. However, when the recycled toner supplying rate is low, only the pre-transfer eraser 11E illuminates so as to decrease the light amount. This selective changing operation prevents the transfer of the fog toner onto the sheet.

Next, the fourth embodiment of the present invention will be hereinafter explained with reference to FIGS. 32–42. The entire structure of an image forming apparatus according to the fourth embodiment is almost same as in the case of the above first to third embodiments, so that the same components as those of the first embodiment are denoted by the same reference numerals in the fourth embodiment, and no explanation is provided thereof.

Figure 32:
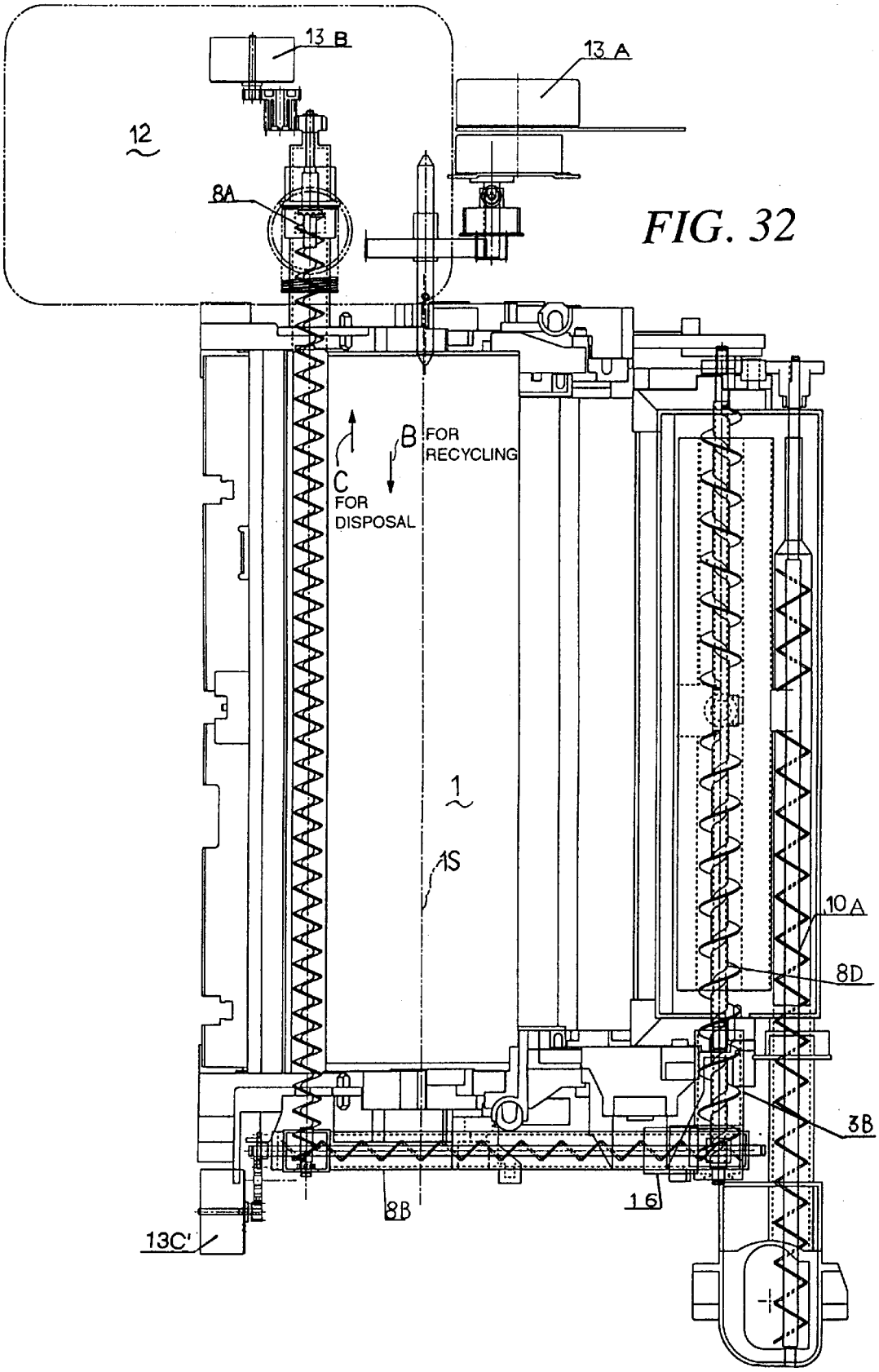
FIG. 32 is a top view of a recycling unit in a fourth embodiment of the present invention.

FIG. 32 is a view showing a recycling unit according to the fourth embodiment of the present invention. The difference of the recycling unit of the fourth embodiment from that of the first embodiment is that the second conveyer mechanism 8B of the fourth embodiment is driven by a driving motor 13C' which differs from the driving motors 13A and 13B. When the collected toner is disposed of, in order to prevent a toner conveyance route from being blocked with toner, the second conveyer mechanism 8B has a structure to which a driving force is not transmitted by a one-way clutch, or in which the driving motor 13C' is turned off. The conveyance route for disposing of or recycling the collected toner in the recycling unit according to the fourth embodiment is shown in FIG. 40(*a*). As the conveyer mechanism, a spiral member which is rotatably driven can be employed.

Hereafter, an operation for controlling the toner recycling according to the fourth embodiment will be explained. The recycled toner has decreased fluidity. The continuous copying, or double-sided copying operation in this state increases temperature in the apparatus, which further decreases the toner fluidity. Then, the toner is further deposited on blades of the first and second conveyer mechanisms 8A and 8B, owing to which, toner particles are solidified. The solidified toner particles stay without moving, thereby increasing torque of the driving motor output.

Figure 33:
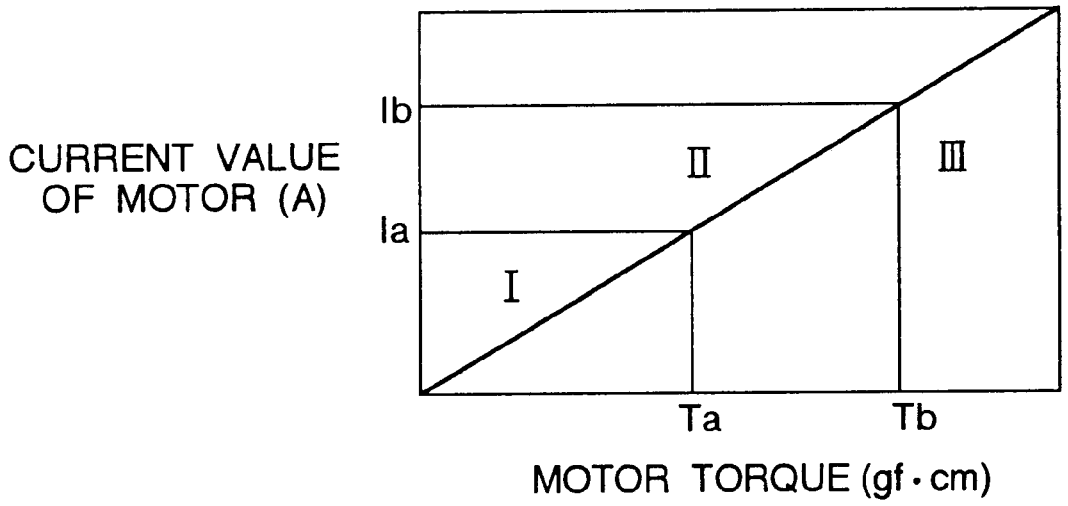
FIG. 33 is a view of relationship between the motor torque and the current value of motor output in the fourth embodiment of the present invention.
Figure 34:
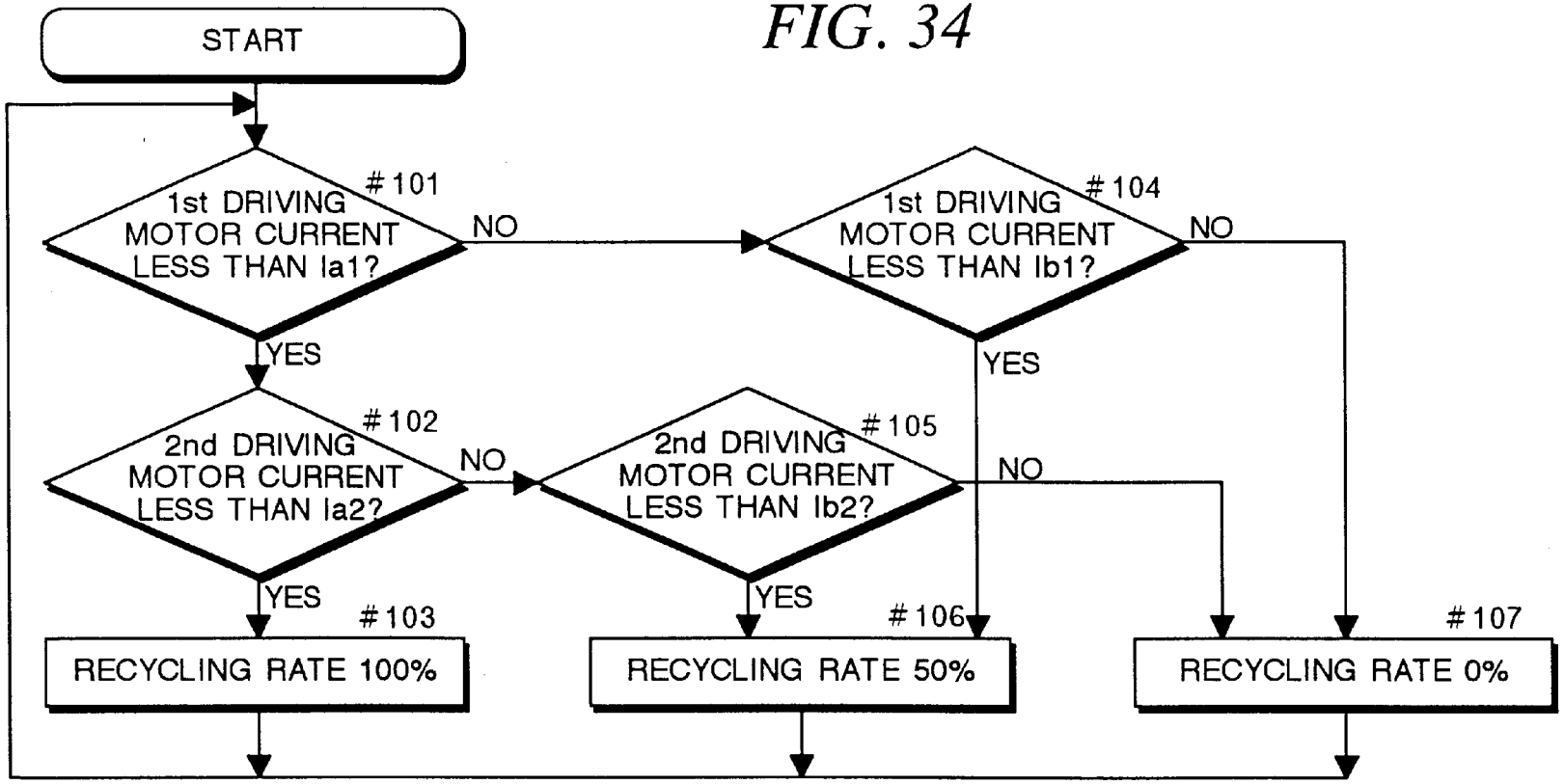
FIG. 34 is a flowchart for controlling the recycled toner supplying rate in accordance with torque in the fourth embodiment of the present invention.
Figure 42:
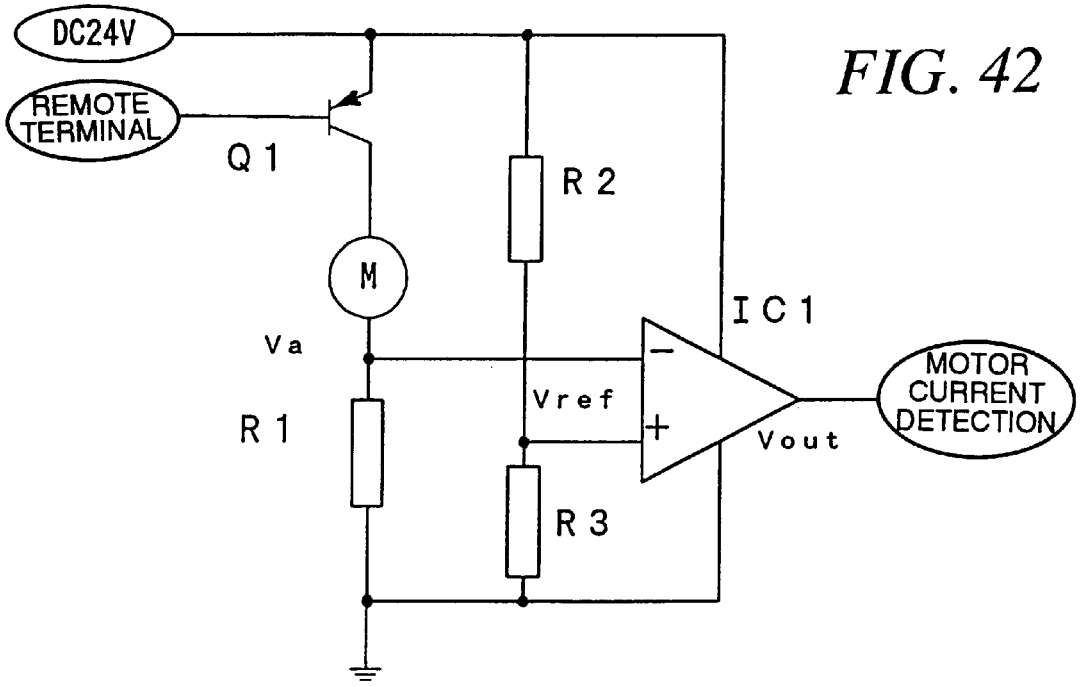
FIG. 42 is a circuit diagram for detecting motor current in the fourth embodiment of the present invention.

FIG. 33 shows a relationship between the torque and current value of motor output in the first and second driving motors 13B and 13C'. FIG. 34 is a flowchart for controlling the recycled toner supplying rate in accordance with driving torque. FIG. 42 is a circuit diagram for detecting motor current. In FIG. 42, a motor M and a controlling transistor Q1 and current detection resistor R1 are connected in series, and a remote terminal is given a control signal. A comparator IC1 compares a potential Va of the resistor R1 with a reference potential Vref so as to detect the motor current. As shown in these figures, when the motor torque of the driving motors 13B and 13C' of the first and second conveyer mechanisms 8A and 8B is predetermined value Ta or less, the torque is determined to be steady torque state I (FIG. 33). In the steady torque state I, the recycled toner supplying rate is set for 100% (#103) which means a fully recycling operation. Each of the first and second driving motors 13B and 13C' has a predetermined relationship between the torque and current value of the motor (when the torque takes on value Ta, the current value is Ia; when the torque takes on value Tb, the current value is Ib). When the torque of the driving motor having larger torque is larger than specified value Ta (Ta1, Ta2), and smaller than value Tb (Tb1, Tb2), it is determined to be a torque state II. In the torque II, the recycled toner supplying rate is set for 50% (#106) which means a half recycling operation in which collecting and recycling operations are alternately repeated. One of the torques of the driving motor 13B or 13C' is larger than value Tb (Tb1, Tb2), it is determined to be a torque state III. In the torque state III, the recycled toner supplying rate is set for 0% (#107), so that all of the toner is collected and disposed of. In an actual controlling operation, the control is carried out by employing each of the current value of the motor output Ia (Ia1, Ia2), and Ib (Ib1, Ib2) for recycling and collecting (disposing of) the toner. In the present embodiment, a control pattern is divided into three stages, but it can be divided into more patterns.

In the above-described toner recycling control of the present embodiment:

(1) If conveyance load, that is, torque of the driving motor, increases, the recycled toner supplying rate is decreased (refer to FIG. 41); and if the torque of the driving motor exceeds a specified set level, the collected toner is not recycled but disposed of, thereby the solidified toner is prevented from being transmitted into the developing unit so that an image noise caused by the solidified toner can be decreased.

(2) In a state when the torque of the driving motor slightly increases, the second conveyer mechanism 8B is stopped to be driven, and the toner is collected (disposed) by the reverse rotation of the driving motor 13B of the first conveyer mechanism 8A. If the recycling operation is restarted when the temperature in the apparatus and the torque are decreased by stopping the continuous copying or double-sided copying operation, the toner is not conveyed into a pipe of the second conveyer mechanism 8B during a toner collecting (disposal) operation, thereby preventing an increase of the solidified toner particles, and decreasing the image noise.

(3) If the recycled toner supplying rate is set for 50%, the collecting and recycling operations are carried out intermittently, which decreases rate of the occurrence of the image noise per one copied page even if the solidified toner particles are generated. Consequently, the image quality is maintained to a level which makes no problem in practical use.

FIG. 35 is a graph of a timing sequence in the toner collecting and recycling operations.

(1) In order to change from the collecting mode to recycling mode, driving time F of the first conveyance motor 13B (first conveyer mechanism 8A) is set to be longer than driving time E of the photoreceptor drum I and developing unit 3. In this state, the relationship of E<F is established. Accordingly, since all of the toner remaining in the pipe of the first conveyer mechanism 8A is collected, so that the toner having a possibility of generating the solidified particles can be collected and disposed of, which allows the high quality to be maintained in the copying operation.

(2) As to a conveyer of the second driving motor 13C' (second conveyer mechanism 8B), in the case of the single motor driving of the present embodiment, while the first conveyer mechanism 8A collects (dispose of) the toner, the driving motor 13C' of the second conveyer mechanism 8B intermittently drives so as to send the solidified toner particles into the developing unit 3, thereby clearing the toner remaining in the conveyance route (pipe). In this intermittent driving, the driving motor 13C' of the second conveyer mechanism 8B drives for a few seconds G in an appropriate cycle, and repeatedly drives for a few cycles. In this state, relationship of E>>G is established. Accordingly, the remaining toner is sent into the developing unit little by little. The toner remaining in the pipe of the conveyer mechanism is totally ejected, so that the solidified toner particles can be prevented from generating, which greatly decreases the possibility of making an image noise. Further, in the case of a modified embodiment shown in FIG. 39, the second conveyer mechanism 8B which is structured so as to be driven through a one-way clutch, is not driven to convey the toner while the first conveyer mechanism 8A collects (disposes of) the toner.

FIG. 36 is a front view of an operation panel unit 27 of the apparatus, and FIG. 37 shows a display example. The operation panel 27 includes a liquid crystal display (LCD) panel 28 and various kinds of keys. The LCD panel 28 displays a simplified diagram concerning a developing process as shown in FIG. 37, so that a user can visually recognize whether the apparatus is in a recycling state or a collecting state. Thus, in response to the operation state, a recycling display LED (light emitting diode) 18A, a collecting display LED (18B), or a shutter-open display LED 18C is illuminated by a microcomputer based on the results detected by various detectors.

FIG. 38 shows a structure around a shutter of the second conveyer mechanism 8B. In the present embodiment, the recycling unit is provided with an openable shutter 16 at some midpoint of the conveyance route of the second conveyer mechanism 8B for preventing the toner from scattering in a maintenance operation such as a replacement of the photoreceptor or developer. Further, the developing unit 3 includes a sensor 19 for detecting the opening and closing of the shutter 16. When the shutter 16 is closed, the toner is collected (disposed) without recycled so as to allow the copying operation. As the detection sensor 19, other detecting devices such as a proximity sensor, photosensor as well as a micro switch can be employed.

In the apparatus in which the openable shutter is provided in the conveyance route for recycling, if a serviceperson makes a copy with the shutter closed after the maintenance operation, the driving torque for conveyance may increase, which may cause a problem of generating the solidified toner particles. However, due to the structure in which the LCD panel 28 displays the opening and closing state of the shutter, the user can easily recognize the shutter state, and the above-mentioned problem can be avoided.

Figure 39:
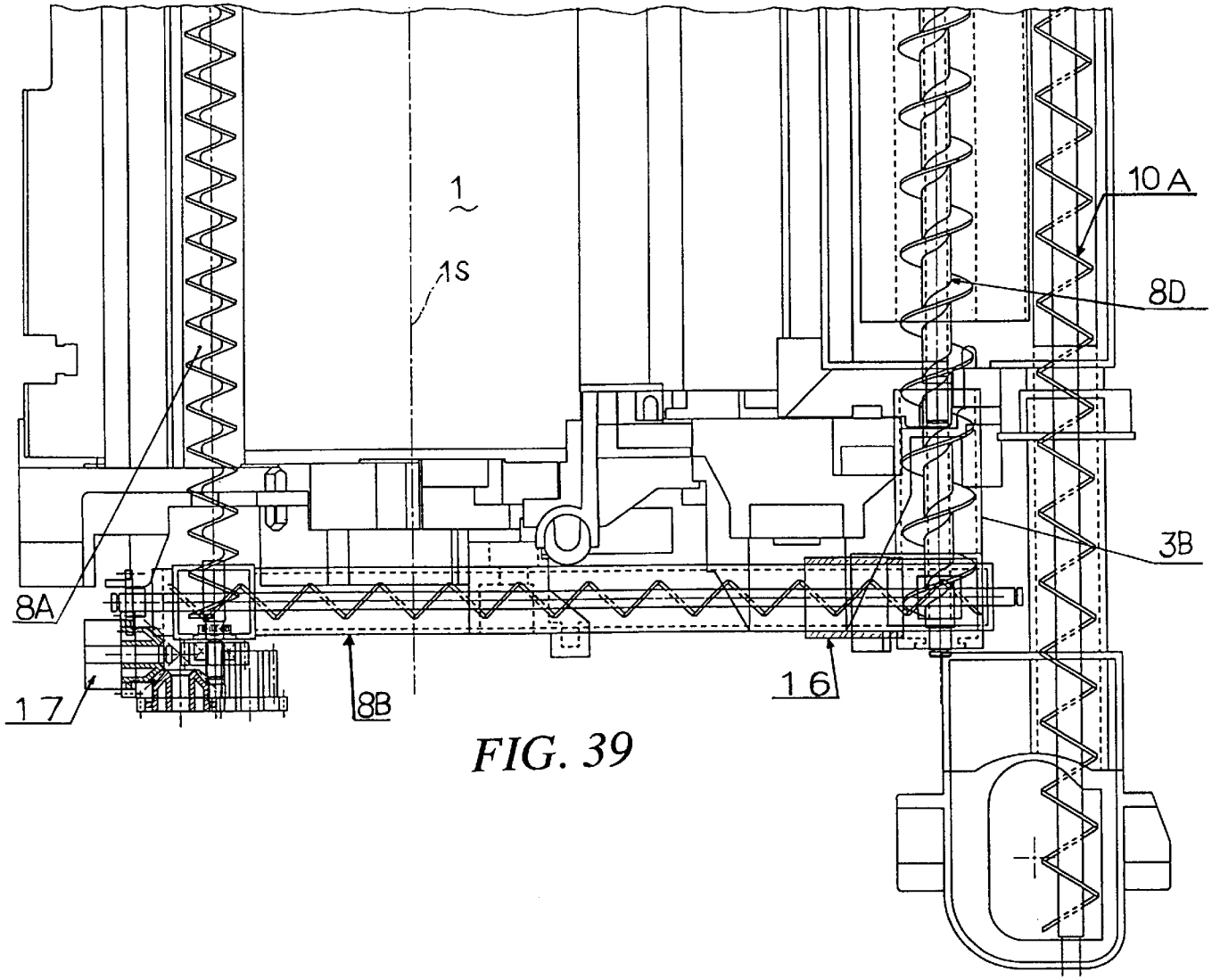
FIG. 39 is a top view of the second conveyer mechanism in an alternative embodiment of the present invention.

FIG. 39 shows a structure of the conveyer mechanism in accordance with an alternative embodiment. In this structure, the second conveyer mechanism 8B is not driven by a motor, but driven by a transmitted driving force from the first conveyer mechanism 8A through a clutch using a solenoid 17. Other components are same as those of the above-mentioned fourth embodiment.

Figure 40B:
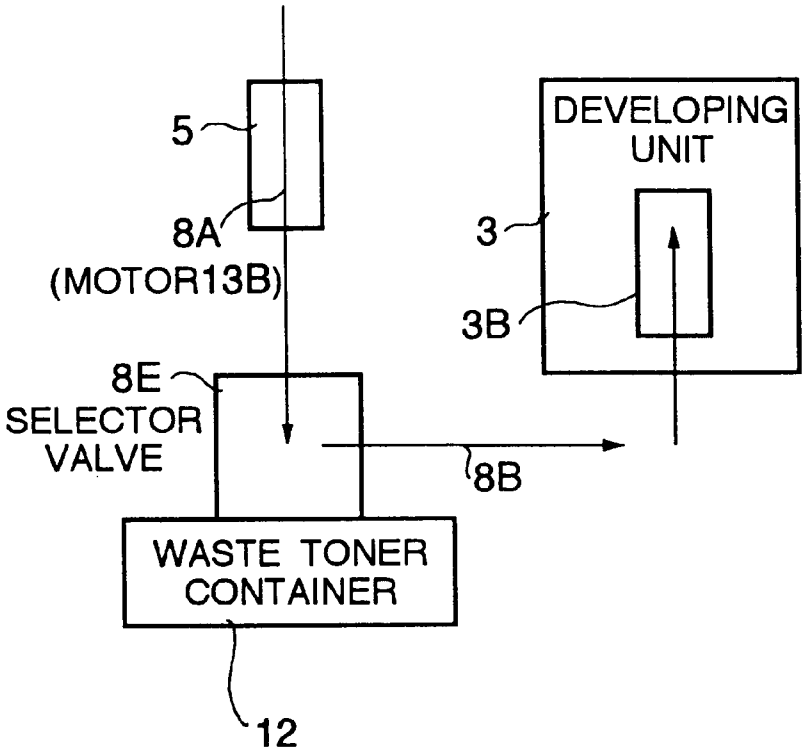
FIGS. 40(*a*) and 40(*b*) are views of toner conveying routes respectively in the fourth embodiment and a modified embodiment thereof according to the present invention.
Figure 40A:
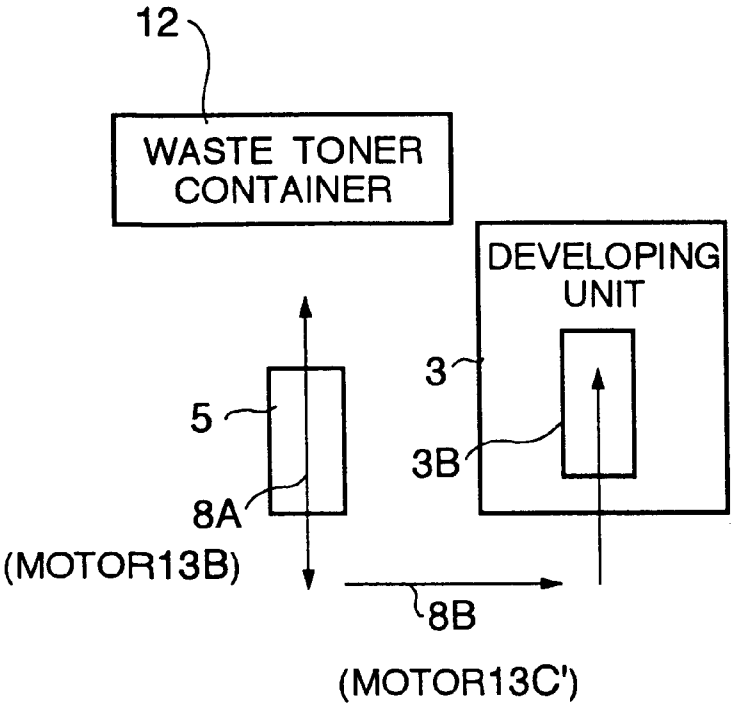
Figure 41:
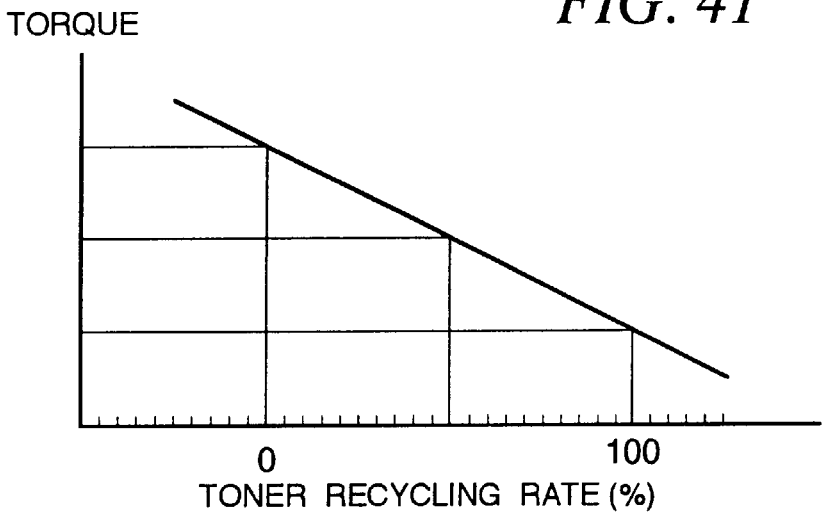
FIG. 41 is a graph of a relationship between the toner recycling rate and the torque in the fourth embodiment of the present invention.

Further, concerning the conveying route for recycling the toner in the fourth embodiment, it is possible to provide a structure as shown in FIG. 40(b) comprising the selector valve 8E and waste toner container 12 between the first and second conveyer mechanisms 8A and 8B wherein the collected toner is conveyed into the second conveyer mechanism 8B for recycling, and into the waste toner container 12 by the selection of the valve 8E.

The present invention is not limited to the above-described embodiment, but includes varied or modified embodiments from the above. For example, since there occurs a timing lag while the collected substance (toner and the like) is conveyed by the conveyer mechanism, the changing of the recycling rate can be controlled considering the time lag. Besides, although the above embodiment shows the case of collecting the remaining toner on the photoreceptor drum 1, the toner on a photoreceptive belt or an intermediate transfer drum/belt can be collected. Also, in the cleaning unit 5, the toner can be collected by not only the blade, but a brush, roller, or complex structure thereof. Further, the developing unit 3 can be structured in various configurations. The image forming conditions may include a type of transferred material, black-to-white ratio of an image, dot-counted value, document density, amount of developer toner consumed, number of printed pages, print mode, environment and the like. When these value exceed reference value, the recycling rate is lowered (second conveyance is decreased compared to first conveyance). The reference level can be prepared in a table, or determined by equations.

What is claimed is:

1. An image forming apparatus comprising:

an image carrier;

a developing device which develops an image onto said image carrier by developer;

a developer supplying device which supplies the developer to said developing device;

a cleaner which collects the developer on a surface of said image carrier;

a conveyer mechanism which conveys the developer collected by said cleaner to either of a first part for disposal and a second part for supplying the collected developer to said developing device; and, a control which controls operations of said conveyer mechanism and developer supplying device according to image forming conditions wherein the controller controls toner density in the developer to be supplied to the developing device by the developer supplying device according to the control of the conveyer mechanism.

2. The image forming apparatus as claimed in claim 1, wherein the image forming conditions include at least one of type of transferred material, black and white ratio of an image, dot-counted value, image density, an amount of consumed toner contained in the developer, number of image formed pages, type of image forming mode and ambient environment.

3. The image forming apparatus as claimed in claim 1, wherein the controller controls a ratio between the amount of the collected developer to be conveyed to the first part and second part by the conveyer mechanism.

4. The image forming apparatus as claimed in claim 3, wherein the controller carries out a control for decreasing toner density of the developer when a ratio of the amount of the collected developer to be conveyed into the second part is increased.

5. The image forming apparatus as claimed in claim 3, wherein the controller carries out a control for decreasing toner density of the developer when the toner density is increased in the developer.

6. The image forming apparatus as claimed in claim 1, wherein said control of the toner density is carried out by controlling supplying amount of fresh developer.

7. A control method in an image forming apparatus which collects developer on an image carrier so as to re-supply the collected developer to a developing device, comprising:

a step of setting a ratio between recycling and disposal of the collected developer; and, a step of carrying out a control of toner density in the developer according to said ratio.

8. The method as claimed in claim 7, wherein the control of the toner density is carried out by controlling supplying amount of fresh developer.

9. The method as claimed in claim 7, wherein the toner density is decreased when a ratio of recycling exceeds a predetermined value.

10. The method as claimed in claim 7, wherein the ratio between the recycling and disposal is determined by predetermined image forming conditions.

11. The method as claimed in claim 10, wherein the image forming conditions include at least one of type of transferred material, black and white ratio of an image, dot-counted value, image density, an amount of consumed toner contained in the developer, number of image formed pages, type of image forming mode and ambient environment.

12. An image forming apparatus comprising:

an image carrier;

a cleaner which collects developer on a surface of said image carrier;

a conveyer mechanism which conveys developer collected by said cleaner to one of a first part for disposal and a second part for recycling; and, a controller which determines a ratio between the amount of the collected developer to be conveyed to the first part and second part according to image forming conditions, and controls said conveyer mechanism according to the determined ratio.

13. The image forming apparatus as claimed in claim 12, wherein the image forming conditions include at least one of type of transferred material, black and white ratio of an image, dot-counted value, image density, amount of consumed toner contained in the developer, number of image formed pages, type of image forming mode and ambient environment.

14. A control method in an image forming apparatus which collects developer on an image carrier so as to recycle and dispose of the collected developer, comprising:

a step of determining a ratio between recycling and disposal of the collected developer according to image forming conditions; and, a step of controlling conveyance of the collected developer according to the determined ratio.

15. The control method as claimed in claim 14, wherein the image forming conditions include at least one of type of transferred material, black and white ratio of an image, dot-counted value, image density, amount of consumed toner contained in the developer, number of image formed pages, type of image forming mode and ambient environment.

16. An image forming apparatus comprising:

an image carrier;

a cleaner which collects developer on a surface of said image carrier;

a detector which detects a state of the surface of said image carrier;

a conveyor mechanism which conveys developer collected by said cleaner to either of a first part for disposing of the collected developer and a second part for recycling the collected developer as developer; and, a controller which controls a ratio between recycling and disposal of the collected developer by said conveyor mechanism in response to detection of said detector.

17. The image forming apparatus as claimed in claim 16, wherein the detector detects the surface of the image carrier in a state that no developer is carried on the image carrier.

18. The image forming apparatus as claimed in claim 16, wherein the controller controls said conveyer mechanism according to an image forming condition.

19. The image forming apparatus as claimed in claim 18, wherein the image forming condition include at least one of type of transferred material, black and white ratio of an image, dot-counted value, image density, amount of consumed toner contained in the developer, number of image formed pages, type of image forming mode and ambient environment.

20. A control method in an image forming apparatus which collects developer on an image carrier so as to recycle and dispose of the collected developer, comprising:

a step of carrying out a detection of a surface state of the image carrier; and, a step of carrying out a control between recycling and disposal of the collected developer according to the detected result and image forming conditions.

21. The control method as claimed in claim 20, wherein said detection of the surface state is carried out for the surface in a state that no developer is carried thereon.

22. The control method as claimed in claim 20, wherein said control determines a ratio between the recycling and disposal, and conveys the collected developer based on the determined ratio.

23. An image forming apparatus comprising:

an image carrier;

a cleaner which collects developer on a surface of said image carrier;

a conveyer mechanism which conveys the developer collected by said cleaner to either of a first part for disposal and a second part for recycling; and, a controller which carries out a control of said conveyer mechanism, and according to said control of the conveyer mechanism, carries out a control of transfer conditions for transferring an image on the image carrier to a transferred material.

24. The image forming apparatus as claimed in claim 23, wherein the control of said conveyer mechanism is carried out based on image forming conditions.

25. The image forming apparatus as claimed in claim 24, wherein the image forming conditions include at least one of type of transferred material, black and white ratio of an image, dot-counted value, image density, an amount of consumed toner contained in the developer, number of image formed pages, type of image forming mode and ambient environment.

26. The image forming apparatus as claimed in claim 23 further comprising a transfer charger.

27. The image forming apparatus as claimed in claim 26, wherein output voltage from the transfer charger is controlled.

28. The image forming apparatus as claimed in claim 23, wherein the controller controls a ratio between the amount of the collected developer to be conveyed by the conveyer mechanism to the first part and second part.

29. The image forming apparatus as claimed in claim 28 further comprising a transfer charger, wherein the controller controls output voltage of said transfer charger according to ratio of the amount of the collected developer to be conveyed to the first part and second part.

30. The image forming apparatus as claimed in claim 29, wherein the output voltage is decreased as a ratio of the conveyance amount to the second part increases.

31. A control method in an image forming apparatus which collects developer on an image carrier so as to recycle and dispose of the collected developer, comprising:

a step of conveying the collected developer at a predetermined ratio between the disposal and recycling; and, a step of carrying out a control of transferring conditions for transferring an image on an image carrier to a recording material according to said ratio.

32. The control method as claimed in claim 31, wherein said control adjusts output voltage of a transfer charger.

33. The control method as claimed in claim 32, wherein output voltage of the transfer charger is decreased as the recycling ratio increases.

34. The control method as claimed in claim 31, wherein the ratio between the recycling and disposal is determined based on image forming conditions.

35. An image forming apparatus comprising:

an image carrier;

a developing device which develops an image onto said image carrier by developer;

a cleaner which collects developer on a surface of said image carrier;

a first conveyer mechanism which conveys developer collected by said cleaner to a predetermined part for disposal;

a collecting mechanism which collects scattered developer;

a second conveyer mechanism which conveys the developer collected by said collecting mechanism to said predetermined part; and a sensor which detects an amount of the developer collected by said collecting mechanism.

36. The image forming apparatus as claimed in claim 35, wherein said collecting mechanism is located close to a part where the developer scatters.

37. The image forming apparatus as claimed in claim 36, wherein said collecting mechanism is located close to the developing device.

38. The image forming apparatus as claimed in claim 35, wherein said collecting mechanism sucks in the developer for collecting.

39. The image forming apparatus as claimed in claim 35 wherein a conveyance by said second conveyer mechanism is controlled according to output from said sensor.

40. The image forming apparatus as claimed in claim 35, wherein said second conveyer mechanism conveys the collected developer to a predetermined part when the output from said sensor reaches a predetermined value.

41. The image forming apparatus as claimed in claim 35, wherein said second conveyer mechanism conveys the collected developer to the predetermined part when usage amount of the developer reaches a predetermined amount.

42. The image forming apparatus as claimed in claim 35, further comprising a third conveyer mechanism which conveys the developer collected by said cleaner to a third part for recycling.

43. The image forming apparatus as claimed in claim 42, wherein said first and third conveyer mechanisms are controlled according to image forming conditions.

44. The image forming apparatus as claimed in claim 43, wherein the image forming conditions include at least one of type of transferred material, black and white ratio of an image, dot-counted value, image density, amount of consumed toner contained in the developer, number of image formed pages, type of image forming mode and ambient environment.

45. The image forming apparatus as claimed in claim 35, wherein said predetermined part is a disposal box.

46. An image forming apparatus comprising:

an image carrier;

a cleaner which collects developer on a surface of said image carrier;

a conveyer mechanism which conveys the developer collected by said cleaner to either of a first part for disposal and a second part for recycling;

a detector which detects conveyance load of said conveyer mechanism; and, a controller which controls operations of said conveyer mechanism according to said detection result.

47. The image forming apparatus as claimed in claim 46, wherein said detector detects torque of a motor for driving the conveyer mechanism.

48. The image forming apparatus as claimed in claim 46, wherein said detector detects current of the motor for driving the conveyer mechanism.

49. The image forming apparatus as claimed in claim 46, wherein said controller decreases a ratio of the collected developer conveyed to the second part by the conveyer mechanism when the conveyance load increases.

50. A control method in an image forming apparatus in which a conveyer mechanism conveys collected developer on an image carrier to a predetermined part for disposal and recycling:

a step of detecting conveyance load of said conveyer mechanism; and, a step of controlling a ratio between the disposal and recycling by the conveyer mechanism according to said detection result.

51. The control method as claimed in claim 50, wherein the conveyance ratio for recycling by the conveyer mechanism is decreased when the conveyance load increases.

52. The control method as claimed in claim 50, wherein motor torque for driving the conveyer mechanism is detected in the conveyance load detection.

53. The control method as claimed in claim 50, wherein motor current for driving the conveyer mechanism is detected in the conveyance load detection.

54. An image forming apparatus comprising:

a cleaner which collects toner on an image carrier;

a conveyer mechanism which conveys said collected toner to either of a disposal container and a developing device; and, a controller which controls replenishment of fresh toner according to time required for conveying the collected toner to the developing device.

55. The image forming apparatus as claimed in claim 54, wherein the fresh toner replenishment is controlled according to one of predetermined plural patterns.

56. The image forming apparatus as claimed in claim 54, wherein the controller predicts the time required for said conveyance according to a toner amount required for forming an image.

57. The image forming apparatus as claimed in claim 56, wherein said toner amount is detected based on density of an image to be formed.

58. The image forming apparatus as claimed in claim 57, wherein dots of the image are counted in detection of image density.

59. The image forming apparatus as claimed in claim 57, wherein detection of image density is carried out by an AE sensor which is located close to an exposure unit.

60. The image forming apparatus as claimed in claim 54, wherein said controller starts to replenish the fresh toner after a lapse of said time.

* * * * *